US007766083B2

(12) United States Patent
Willett et al.

(10) Patent No.: US 7,766,083 B2
(45) **Date of Patent: *Aug. 3, 2010**

(54) METHODS OF ISOLATING HYDRAJET STIMULATED ZONES

(75) Inventors: Ronald M. Willett, Midland, TX (US); Jim B. Surjaatmadja, Duncan, OK (US); Billy W. McDaniel, Duncan, OK (US); Leldon Mark Farabee, Houston, TX (US); David M. Adams, Houston, TX (US); Lloyd E. East, Cypress, TX (US)

(73) Assignee: Halliburton Energy Services, Inc., Duncan, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/739,188

(22) Filed: Apr. 24, 2007

(65) Prior Publication Data

US 2008/0110622 A1 May 15, 2008

Related U.S. Application Data

(63) Continuation of application No. 10/807,986, filed on Mar. 24, 2004, now Pat. No. 7,225,869.

(51) Int. Cl.
*E21B 43/26* (2006.01)
*E21B 43/267* (2006.01)
*E21B 43/114* (2006.01)

(52) U.S. Cl. ..... 166/308.1; 166/280.1; 166/280.2; 166/305.1; 166/307; 166/308.3; 166/298

(58) Field of Classification Search ..... 166/280, 166/280.1, 280.2, 284, 298, 305.1, 307, 308.1, 166/308.3, 297
See application file for complete search history.

(56) References Cited

U.S. PATENT DOCUMENTS

| | | | |
|---|---|---|---|
| 2,758,653 | A | 8/1956 | Desbrow |
| 2,859,822 | A | 11/1958 | Wright |
| 3,251,993 | A | 5/1966 | Bader et al. |
| 3,664,422 | A | 5/1972 | Bullen |
| 3,712,379 | A | 1/1973 | Hill |

(Continued)

FOREIGN PATENT DOCUMENTS

| | | |
|---|---|---|
| EP | 0427371 | 5/1991 |

(Continued)

OTHER PUBLICATIONS

Notice of Allowance and Notice of Allowability for U.S. Appl. No. 11/221,544, dated Apr. 8, 2009.

(Continued)

*Primary Examiner*—Giovanna C Wright
*Assistant Examiner*—Brad Harcourt
(74) *Attorney, Agent, or Firm*—John W. Wustenberg; McDermott, Will & Emery, LLP

(57) ABSTRACT

The present invention is directed to a method of isolating hydrajet stimulated zones from subsequent well operations. The method includes the step of drilling a wellbore into the subterranean formation of interest. Next, the wellbore may or may not be cased depending upon a number of factors including the nature and structure of the subterranean formation. Next, the casing, if one is installed, and wellbore are perforated using a high pressure fluid being ejected from a hydrajetting tool. A first zone of the subterranean formation is then fractured and stimulated. Next, the first zone is temporarily plugged or partially sealed by installing an isolation fluid into the wellbore adjacent to the one or more fractures and/or in the openings thereof, so that subsequent zones can be fractured and additional well operations can be performed.

42 Claims, 17 Drawing Sheets

U.S. PATENT DOCUMENTS 4,346,761 A * 8/1982 Skinner et al. ..... 166/206
4,524,825 A 6/1985 Fore
4,590,995 A 5/1986 Evans
4,627,491 A 12/1986 Zunkel
4,697,640 A 10/1987 Szarka
4,808,925 A 2/1989 Baird
4,951,751 A 8/1990 Jennings, Jr.
4,962,815 A 10/1990 Schultz et al.
5,117,912 A 6/1992 Young
5,330,005 A 7/1994 Card et al.
5,361,856 A 11/1994 Surjaatmadja et al.
5,363,919 A 11/1994 Jennings, Jr.
5,381,864 A 1/1995 Nguyen et al.
5,406,078 A 4/1995 Jacobson
5,439,055 A 8/1995 Card et al.
5,494,103 A * 2/1996 Surjaatmadja et al. ..... 166/222
5,499,678 A 3/1996 Surjaatmadja et al.
5,501,275 A 3/1996 Card et al.
5,701,954 A 12/1997 Kilgore et al.
5,703,286 A 12/1997 Proett et al.
5,743,334 A 4/1998 Nelson
5,765,642 A 6/1998 Surjaatmadja
5,775,415 A 7/1998 Yoshimi
5,787,986 A 8/1998 Weaver et al.
5,833,000 A 11/1998 Weaver et al.
5,839,510 A 11/1998 Weaver et al.
5,853,048 A 12/1998 Weaver et al.
5,871,049 A 2/1999 Weaver et al.
5,890,536 A 4/1999 Nierode et al.
5,899,958 A 5/1999 Dowell et al.
5,934,377 A 8/1999 Savage
5,941,308 A 8/1999 Malone et al.
6,006,838 A 12/1999 Whiteley et al.
6,012,525 A 1/2000 Burleson et al.
6,047,772 A 4/2000 Weaver et al.
6,056,052 A 5/2000 Mullen et al.
6,070,666 A 6/2000 Montgomery
6,116,343 A 9/2000 Van Petegem et al.
6,186,230 B1 2/2001 Nierode
6,230,805 B1 5/2001 Vercaemer et al.
6,257,338 B1 7/2001 Kilgore
6,286,598 B1 9/2001 Van Petegem et al.
6,286,599 B1 9/2001 Surjaatmadja et al.
6,286,600 B1 9/2001 Hall et al.
6,296,066 B1 10/2001 Terry et al.
6,306,800 B1 10/2001 Samuel et al.
6,394,184 B2 * 5/2002 Tolman et al. ..... 166/281
6,446,727 B1 9/2002 Zemlak et al.
6,474,419 B2 11/2002 Maier et al.
6,488,091 B1 12/2002 Weaver et al.
6,494,260 B2 12/2002 Van Petegem et al.
6,497,284 B2 12/2002 Van Petegem et al.
6,508,307 B1 1/2003 Almaguer
6,520,255 B2 2/2003 Tolman et al.
6,543,538 B2 4/2003 Tolman et al.
6,547,011 B2 4/2003 Kilgore
6,554,075 B2 4/2003 Fikes et al.
6,581,699 B1 6/2003 Chen et al.
6,601,646 B2 8/2003 Streigh et al.
6,604,581 B2 8/2003 Moake et al.
6,613,720 B1 9/2003 Feraud et al.
6,632,778 B1 10/2003 Ayoub et al.
6,644,110 B1 11/2003 Curtis et al.
6,662,874 B2 12/2003 Surjaatmadja et al.
6,667,280 B2 12/2003 Chang et al.
7,017,665 B2 3/2006 Nguyen
7,114,567 B2 10/2006 Chan et al.
7,225,869 B2 * 6/2007 Willett et al. ..... 166/280.1
7,571,766 B2 * 8/2009 Pauls et al. ..... 166/280.1
2002/0007949 A1 * 1/2002 Tolman et al. ..... 166/280
2004/0206504 A1 10/2004 Rosato
2005/0252659 A1 * 11/2005 Sullivan et al. ..... 166/280.1

FOREIGN PATENT DOCUMENTS

EP 0823538 2/1998
SU 138554 9/1960
SU 147156 6/1961
SU 678181 8/1979
WO WO2005090747 9/2005

OTHER PUBLICATIONS

Decision to Grant for Russian Patent Application No. 2006137362, dated Jun. 17, 2009.
Notice of Allowance and Notice of Allowability for U.S. Appl. No. 11/221,544, dated Sep. 23, 2009.
Foreign communication from related counterpart application dated Jun. 16, 2005.
Notice of Allowance from related counterpart U.S. Appl. No. 10/807,986 dated Apr. 10, 2007.
Office Action from related counterpart U.S. Appl. No. 10/807,986 dated Jan. 24, 2007.
Office Action from related counterpart U.S. Appl. No. 10/807,986 dated Aug. 31, 2006.
Office Action from related counterpart U.S. Appl. No. 10/807,986 dated Apr. 4, 2006.
Office Action from related counterpart U.S. Appl. No. 10/807,986 dated Nov. 16, 2005.
Office Action from related counterpart U.S. Appl. No. 11/221,544 dated May 7, 2007.
Office Action from related counterpart U.S. Appl. No. 11/221,544 dated Nov. 14, 2007.
Office Action from related counterpart U.S. Appl. No. 11/221,544 dated Jul. 16, 2008.
Knowlton, et al., Depth Control for Openhole Frac Procedure, SPE 21294, Society of Petroleum Engineers, 1990.
Hewett, et al., Induced Stress Diversion: A Novel Approach to Fracturing Multiple Pay Sands of the NBU Field, Uintah Co., Utah, SPE 39945, Society of Petroleum Engineers, 1998.
Connell, et al., Development of a Wireless Coiled Tubing Casing Collar Locator, SPE 54327, Society of Petroleum Engineers, 1999.
Connell, et al., High-Pressure/High-Temperature Coiled Tubing Casing Collar Locator Provides Accurate Depth Control for Single-Trip Perforating, SPE 60698, Society of Petroleum Engineers, 2000.
McConkey, et al., Intergration of Conventional Fracturing, Coiled Tubing, and Retrievable Tool Technology, SPE 60709, Society of Petroleum Engineers, 2000.
Rodvelt, et al., Multiseam Coal Stimulation Using Coiled-Tubing Fracturing and a Unique Bottomhole Packer Assembly, SPE 72380, Society of Petroleum Engineers, 2001.
Flowers, et al., Solutions to Coiled Tubing Depth Control, SPE 74833, Society of Petroleum Engineers, 2002.
Cobra Jet VCA Acid Stimulation Recommendation dated Apr. 22, 2003.
Halliburton, Cobra Frac Service, Coiled Tubing Fracturing—Cost-Effictive Method for Stimulating Untapped Reserves, HO2319R, published 2000, Halliburton Energy Services, Inc.
Halliburton, Cobra Frac Service, Cost-Effictive Technology That Can Help Reduce Cost Per BOE Produced, Shorten Cycle Time and Reduce Capex, published Halliburton Communications.
Norris, et al., Multiple Proppant Fracturing of Horizontal Wellbores in a Chalk Formation: Evolving the Process in the Valhall Field, SPE 50608, Society of Petroleum Engineers, 1998.
Granger, et al., Horizontal Well Applications in the Guymon-Hugoton Field: A Case Study, SPE 35641, Society of Petroleum Engineers, 1995.
"SurgiFrac Service Fracture Stimulation Technique for Horizontal Completions in Low-to Medium-Permeability Reservoirs", Halliburton Communications.

* cited by examiner

METHODS OF ISOLATING HYDRAJET STIMULATED ZONES

CROSS REFERENCE TO RELATED APPLICATIONS

This application is a continuation of U.S. patent application Ser. No. 10/807,986 filed Mar. 24, 2004, now U.S. Pat. No. 7,225,869 entitled "Methods of Isolating Hydrajet Stimulated Zones," by Ronald M. Willett et al., which is incorporated by reference herein for all purposes, from which priority is claimed pursuant to 35 U.S.C. §120.

FIELD OF THE INVENTION

The present invention relates generally to well completion operations, and more particularly methods of stimulation and subsequent isolation of hydrajet stimulated zones from subsequent jetting or stimulation operations, so as to minimize the loss of completion/stimulation fluids during the subsequent well jetting or stimulation operations.

BACKGROUND OF THE INVENTION

In some wells, it is desirable to individually and selectively create multiple fractures having adequate conductivity, usually a significant distance apart along a wellbore, so that as much of the hydrocarbons in an oil and gas reservoir as possible can be drained/produced into the wellbore. When stimulating a reservoir from a wellbore, especially those that are highly deviated or horizontal, it is difficult to control the creation of multi-zone fractures along the wellbore without cementing a liner to the wellbore and mechanically isolating the zone being fractured from previously fractured zones or zones not yet fractured.

Traditional methods to create fractures at predetermined points along a highly deviated or horizontal wellbore vary depending on the nature of the completion within the lateral (or highly deviated) section of the wellbore. Only a small percentage of the horizontal completions during the past 15 or more years used a cemented liner type completion; most used some type of non-cemented liner or a bare openhole section. Furthermore, many wells with cemented liners in the lateral were also completed with a significant length of openhole section beyond the cemented liner section. The best known way to achieve desired hydraulic fracturing isolation/results is to cement a solid liner in the lateral section of the wellbore, perform a conventional explosive perforating step, and then perform fracturing stages along the wellbore using some technique for mechanically isolating the individual fractures. The second most successful method involves cementing a liner and significantly limiting the number of perforations, often using tightly grouped sets of perforations, with the number of total perforations intended to create a flow restriction giving a back-pressure of about 100 psi or more, due to fluid flow restriction based on the wellbore injection rate during stimulation, with some cases approaching 1000 psi flow resistance. This technology is generally referred to as "limited entry" perforating technology.

In one conventional method, after the first zone is perforated and fractured, a sand plug is installed in the wellbore at some point above the fracture, e.g., toward the heel. The sand plug restricts any meaningful flow to the first zone fracture and thereby limits the loss of fluid into the formation, while a second upper zone is perforated and fracture stimulated. One such sand plug method is described in SPE 50608. More specifically, SPE 50608 describes the use of coiled tubing to deploy explosive perforating guns to perforate the next treatment interval while maintaining well control and sand plug integrity. The coiled tubing and perforating guns were removed from the well and then the next fracturing stage was performed. Each fracturing stage was ended by developing a sand plug across the treatment perforations by increasing the sand concentration and simultaneously reducing pumping rates until a bridge was formed. The paper describes how increased sand plug integrity could be obtained by performing what is commonly known in the cementing services industry as a "hesitation squeeze" technique. A drawback of this technique, however, is that it requires multiple trips to carry out the various stimulation and isolation steps.

More recently, Halliburton Energy Services, Inc. has introduced and proven the technology for using hydrajet perforating, jetting while fracturing, and co-injection down the annulus. In one method, this process is the SURGIFRAC® fracturing service offered by Halliburton and described in U.S. Pat. No. 5,765,642, which is incorporated herein by reference. The SURGIFRAC® fracturing service has been applied mostly to horizontal or highly deviated wellbores, where casing the hole is difficult and expensive. By using this hydrajetting technique, it is possible to generate one or more independent, single plane hydraulic fractures; and therefore, highly deviated or horizontal wells can be often completed without having to case the wellbore. Furthermore, even when highly deviated or horizontal wells are cased, hydrajetting the perforations and fractures in such wells generally result in a more effective fracturing method than using traditional explosive charge perforation and fracturing techniques. Thus, prior to the SURGIFRAC® fracturing service, methods available were usually too costly to be an economic alternative, or generally ineffective in achieving stimulation results, or both.

SUMMARY OF THE INVENTION

The features and advantages of the present invention will be readily apparent to those skilled in the art upon a reading of the description of the exemplary embodiments, which follows.

The present invention is directed to a method of completing a well using a hydrajetting tool and subsequently plugging or partially sealing the fractures in each zone with an isolation fluid. In accordance with the present invention, the hydrajetting tool can perform one or more steps, including but not limited to, the perforating step, the perforating and fracture steps, and the perforating, fracture and isolation steps.

More specifically, the present invention is directed to a method of completing a well in a subterranean formation, comprising the following steps. First, a wellbore is drilled in the subterranean formation. Next, depending upon the nature of the formation, the wellbore is lined with a casing string or slotted liner. Next, a first zone in the subterranean formation is perforated by injecting a pressurized fluid through a hydrajetting tool into the subterranean formation, so as to form one or more perforation tunnels. This fluid may or may not contain solid abrasives. Following the perforation step, the formation is fractured in the first zone by injecting a fracturing fluid into the one or more perforation tunnels, so as to create at least one fracture along each of the one or more perforation tunnels. Next, the one or more fractures in the first zone are plugged or partially sealed by installing an isolation fluid into the wellbore adjacent to the fractures and/or inside the openings of the fractures. In at least one embodiment, the isolation fluid has a greater viscosity than the fracturing fluid. Next, a second zone of the subterranean formation is perforated and fractured. If it is desired to fracture additional zones of the subterranean formation, then the fractures in the second zone are plugged or partially sealed by the same method, namely, installing an isolation fluid into the wellbore adjacent to the fractures and/or inside the openings of the fractures. The perforating, fracturing and sealing steps are then repeated for the additional zones. The isolation fluid can be removed from fractures in the subterranean formation by circulating the fluid out of the fractures, or in the case of higher viscosity fluids, breaking or reducing the fluid chemically or hydrajetting it out of the wellbore. Other exemplary methods in accordance with the present invention are described below.

An advantage of the present invention is that the tubing string can be inside the wellbore during the entire treatment. This reduces the cycle time of the operation. Under certain conditions the tubing string with the hydrajetting tool or the wellbore annulus, whichever is not being used for the fracturing operation, can also be used as a real-time BHP (Bottom Hole Pressure) acquisition tool by functioning as a dead fluid column during the fracturing treatment. Another advantage of the invention is the tubing string provides a means of cleaning the wellbore out at anytime during the treatment, including before, during, after, and in between stages. Tubulars can consist of continuous coiled tubing, jointed tubing, or combinations of coiled and jointed tubing.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION OF THE INVENTION

Figure 1A:
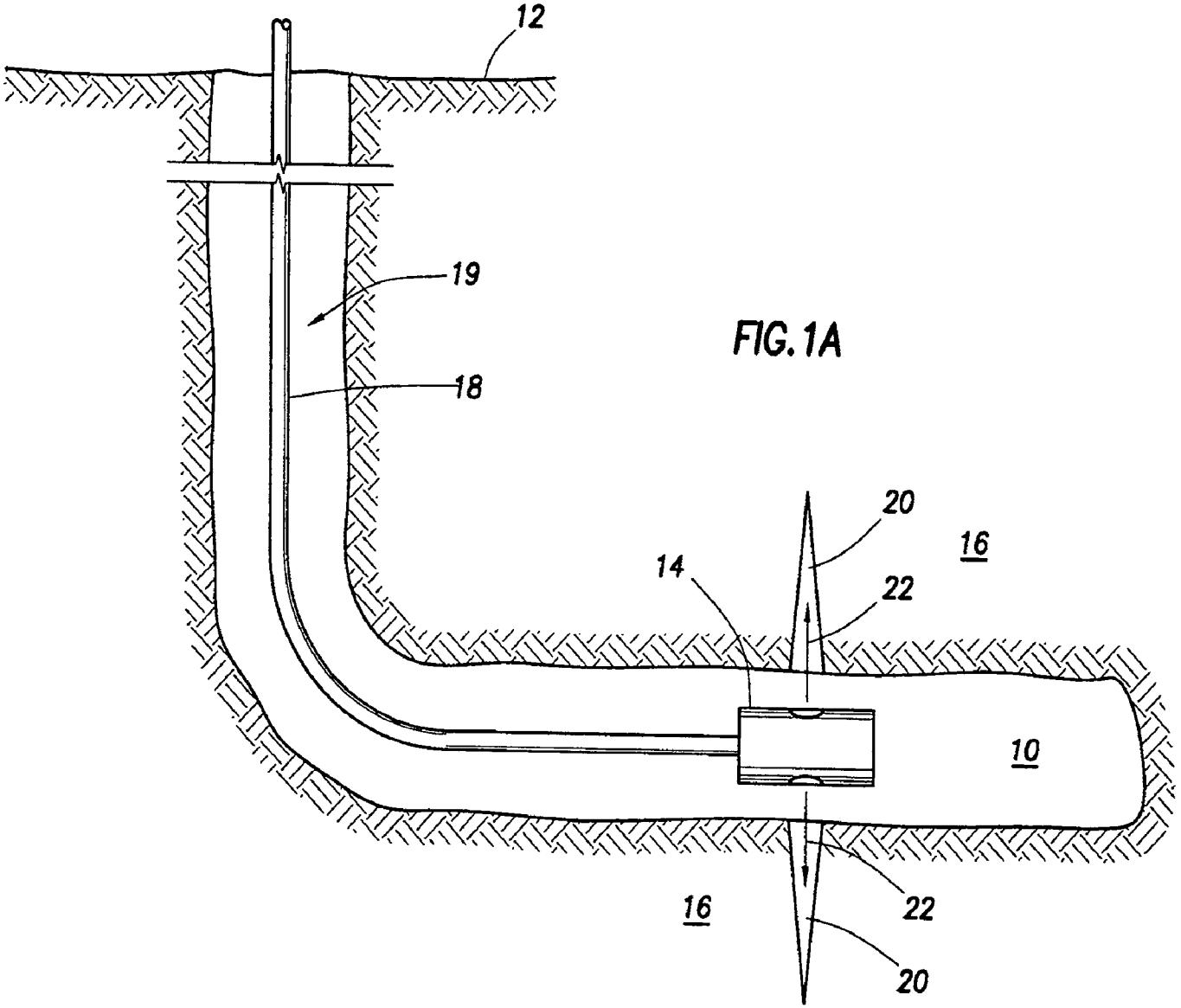
FIG. 1A is a schematic diagram illustrating a hydrajetting tool creating perforation tunnels through an uncased horizontal wellbore in a first zone of a subterranean formation.
Figure 1B:
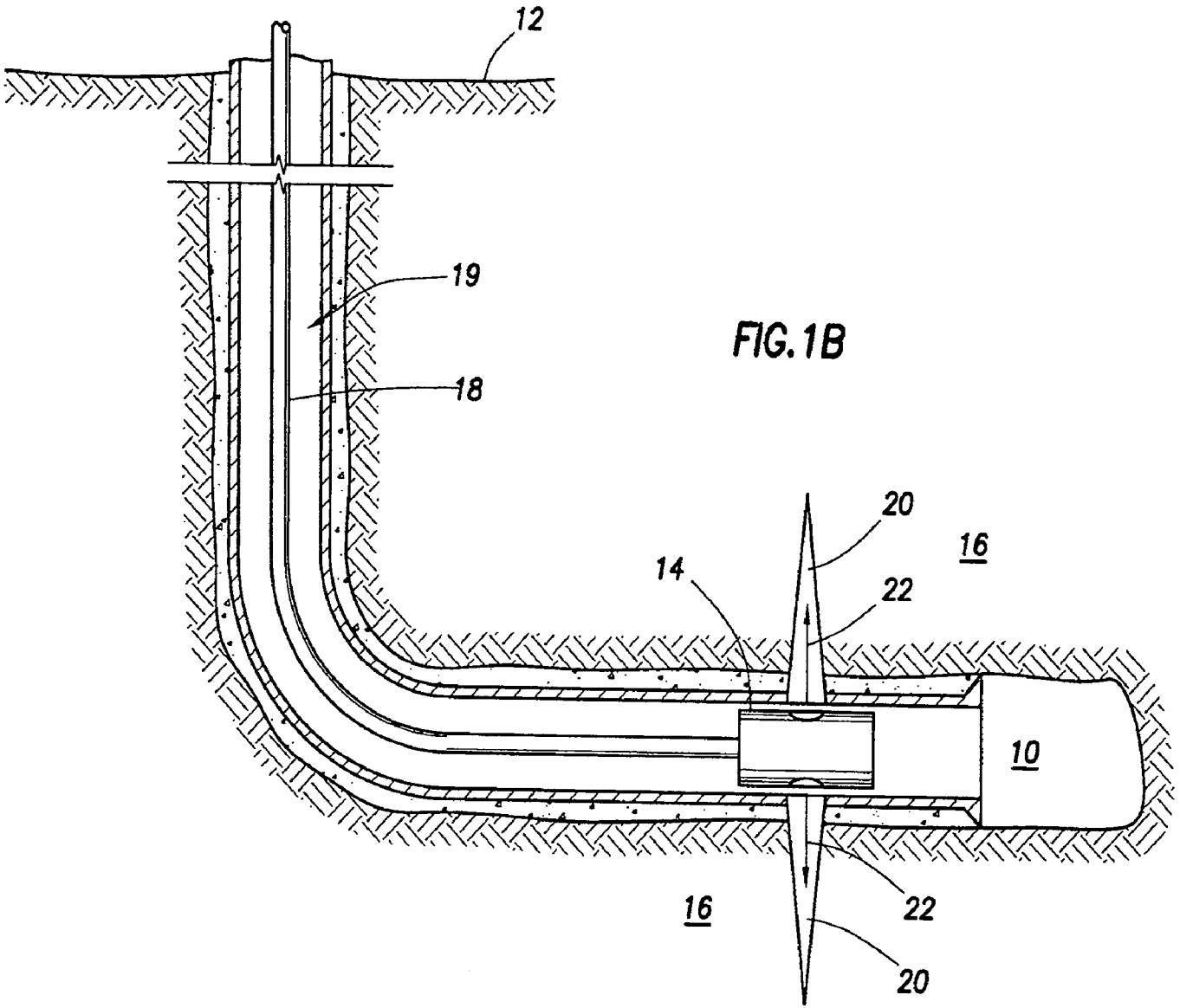
FIG. 1B is a schematic diagram illustrating a hydrajetting tool creating perforation tunnels through a cased horizontal wellbore in a first zone of a subterranean formation.

The details of the method according to the present invention will now be described with reference to the accompanying drawings. First, a wellbore 10 is drilled into the subterranean formation of interest 12 using conventional (or future) drilling techniques. Next, depending upon the nature of the formation, the wellbore 10 is either left open hole, as shown in FIG. 1A, or lined with a casing string or slotted liner, as shown in FIG. 1B. The wellbore 10 may be left as an uncased open hole if, for example, the subterranean formation is highly consolidated or in the case where the well is a highly deviated or horizontal well, which are often difficult to line with casing. In cases where the wellbore 10 is lined with a casing string, the casing string may or may not be cemented to the formation. The casing in FIG. 1B is shown cemented to the subterranean formation. Furthermore, when uncemented, the casing liner may be either a slotted or preperforated liner or a solid liner. Those of ordinary skill in the art will appreciate the circumstances when the wellbore 10 should or should not be cased, whether such casing should or should not be cemented, and whether the casing string should be slotted, preperforated or solid. Indeed, the present invention does not lie in the performance of the steps of drilling the wellbore 10 or whether or not to case the wellbore, or if so, how. Furthermore, while FIGS. 2 through 10 illustrate the steps of the present invention being carried out in an uncased wellbore, those of ordinary skill in the art will recognize that each of the illustrated and described steps can be carried out in a cased or lined wellbore. The method can also be applied to an older well bore that has zones that are in need of stimulation.

Figure 2:
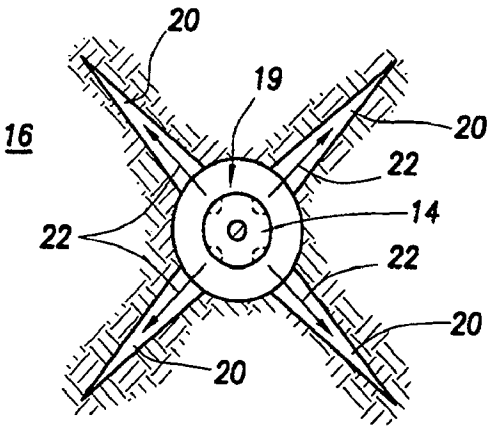
FIG. 2 is a schematic diagram illustrating a cross-sectional view of the hydrajetting tool shown in FIG. 1 forming four equally spaced perforation tunnels in the first zone of the subterranean formation.

Once the wellbore 10 is drilled, and if deemed necessary cased, a hydrajetting tool 14, such as that used in the process described in U.S. Pat. No. 5,765,642, is placed into the wellbore 10 at a location of interest, e.g., adjacent to a first zone 16 in the subterranean formation 12. In one exemplary embodiment, the hydrajetting tool 14 is attached to a coil tubing 18, which lowers the hydrajetting tool 14 into the wellbore 10 and supplies it with jetting fluid. Annulus 19 is formed between the coil tubing 18 and the wellbore 10. The hydrajetting tool 14 then operates to form perforation tunnels 20 in the first zone 16, as shown in FIG. 1. The perforation fluid being pumped through the hydrajetting tool 14 contains a base fluid, which is commonly water and abrasives (commonly sand). As shown in FIG. 2, four equally spaced jets (in this example)

of fluid 22 are injected into the first zone 16 of the subterranean formation 12. As those of ordinary skill in the art will recognize, the hydrajetting tool 14 can have any number of jets, configured in a variety of combinations along and around the tool.

Figure 3:
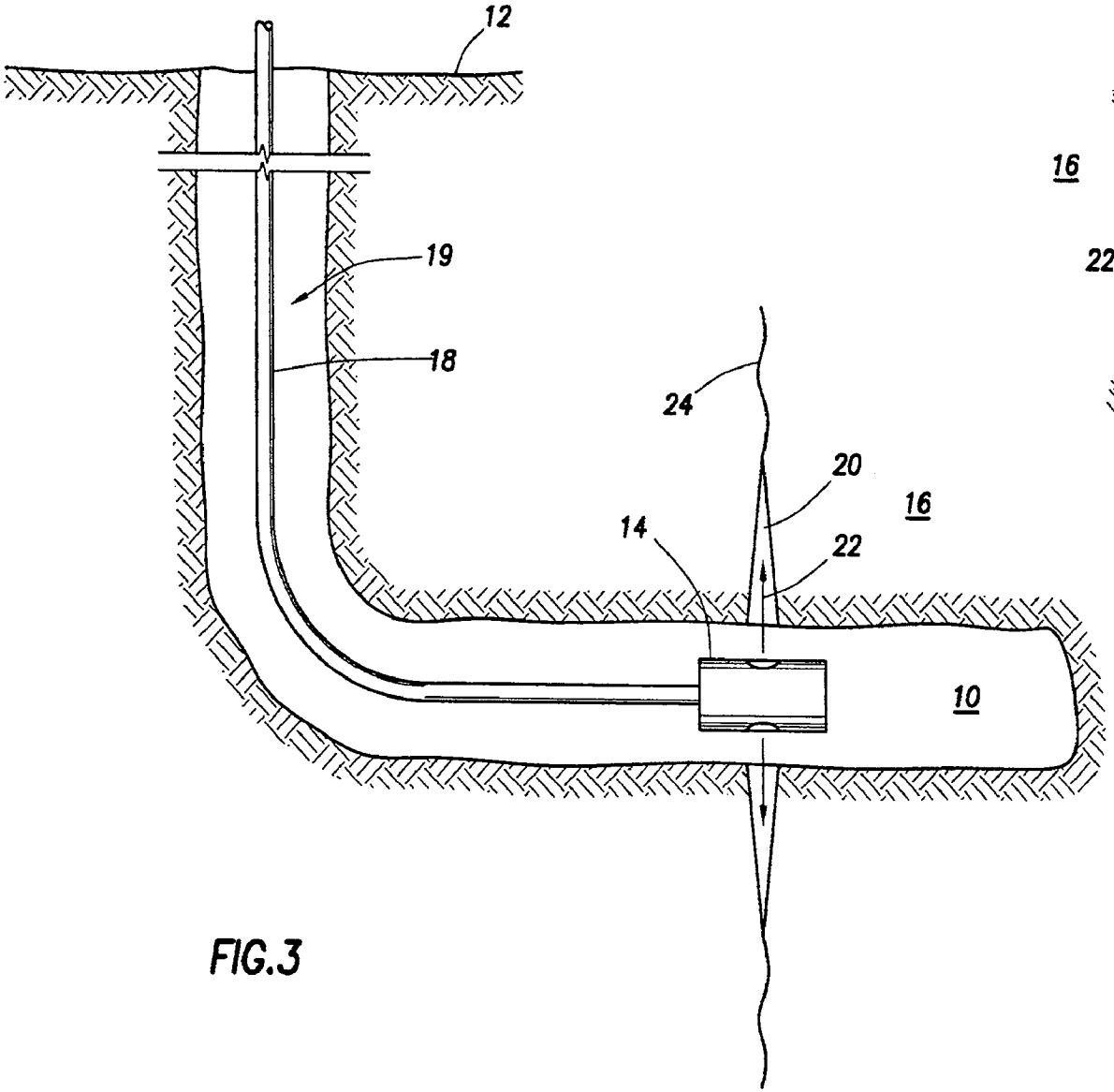
FIG. 3 is a schematic diagram illustrating the creation of fractures in the first zone by the hydrajetting tool wherein the plane of the fracture(s) is perpendicular to the wellbore axis.

In the next step of the well completion method according to the present invention, the first zone 16 is fractured. This may be accomplished by any one of a number of ways. In one exemplary embodiment, the hydrajetting tool 14 injects a high pressure fracture fluid into the perforation tunnels 20. As those of ordinary skill in the art will appreciate, the pressure of the fracture fluid exiting the hydrajetting tool 14 is sufficient to fracture the formation in the first zone 16. Using this technique, the jetted fluid forms cracks or fractures 24 along the perforation tunnels 20, as shown in FIG. 3. In a subsequent step, an acidizing fluid may be injected into the formation through the hydrajetting tool 14. The acidizing fluid etches the formation along the cracks 24 thereby widening them.

In another exemplary embodiment, the jetted fluid carries a proppant into the cracks or fractures 24. The injection of additional fluid extends the fractures 24 and the proppant prevents them from closing up at a later time. The present invention contemplates that other fracturing methods may be employed. For example, the perforation tunnels 20 can be fractured by pumping a hydraulic fracture fluid into them from the surface through annulus 19. Next, either and acidizing fluid or a proppant fluid can be injected into the perforation tunnels 20, so as to further extend and widen them. Other fracturing techniques can be used to fracture the first zone 16.

Once the first zone 16 has been fractured, the present invention provides for isolating the first zone 16, so that subsequent well operations, such as the fracturing of additional zones, can be carried out without the loss of significant amounts of fluid. This isolation step can be carried out in a number of ways. In one exemplary embodiment, the isolation step is carried out by injecting into the wellbore 10 an isolation fluid 28, which may have a higher viscosity than the completion fluid already in the fracture or the wellbore.

Figure 4A:
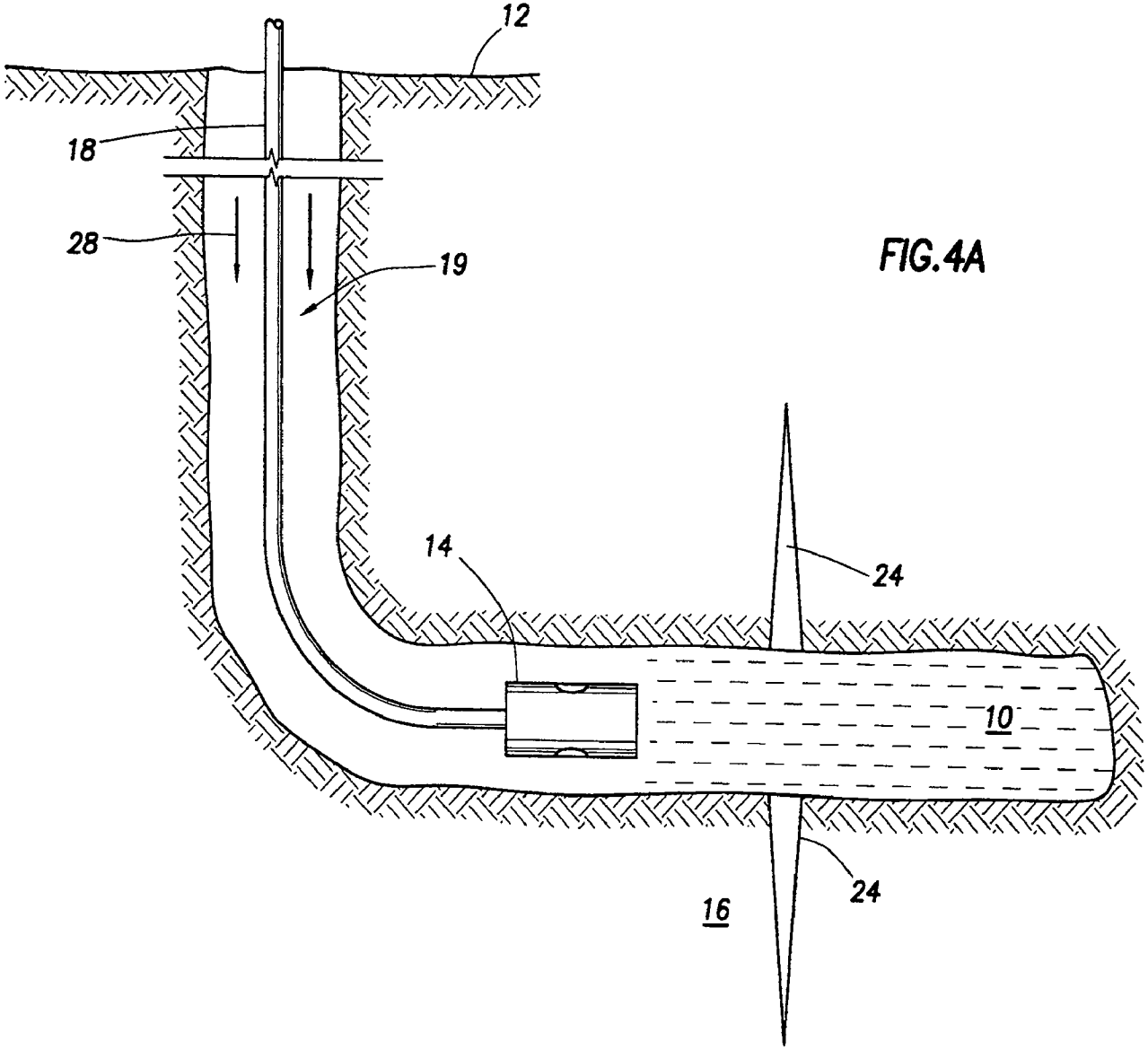
FIG. 4A is a schematic diagram illustrating one embodiment according to the present invention wherein the fractures in the first zone are plugged or partially sealed with an isolation fluid delivered through the wellbore annulus after the hydrajetting tool has moved up hole.
Figure 4B:
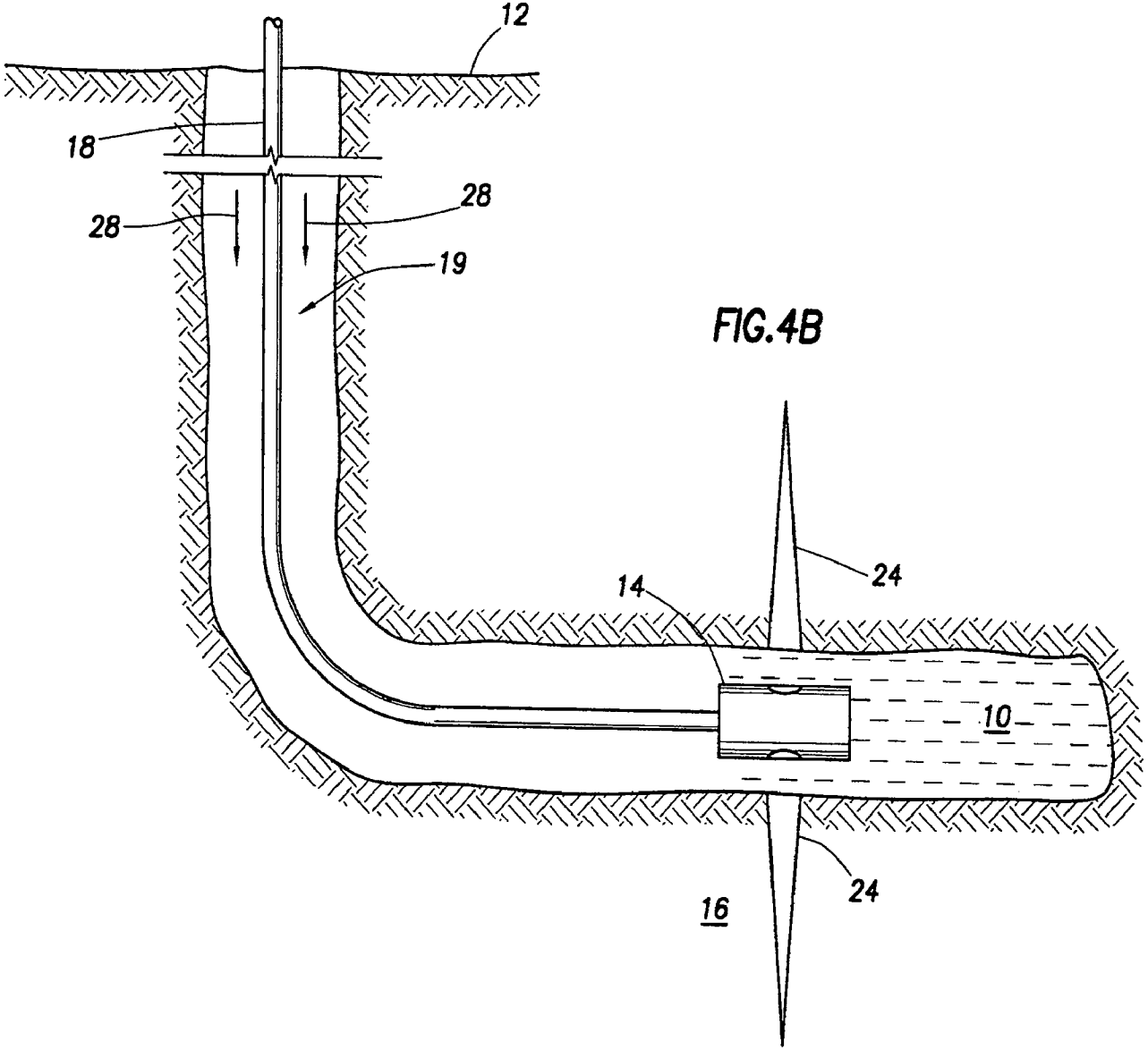
FIG. 4B is a schematic diagram illustrating another embodiment according to the present invention wherein the fractures in the first zone are plugged or partially sealed with an isolation fluid delivered through the wellbore annulus before the hydrajetting tool has moved up hole.

In one embodiment, the isolation fluid 28 is injected into the wellbore 10 by pumping it from the surface down the annulus 19. More specifically, the isolation fluid 28, which is highly viscous, is squeezed out into the annulus 19 and then washed downhole using a lower viscosity fluid. In one implementation of this embodiment, the isolation fluid 28 is not pumped into the wellbore 10 until after the hydrajetting tool 14 has moved up hole, as shown in FIG. 4A. In another implementation of this embodiment, the isolation fluid 28 is pumped into the wellbore 10, possibly at a reduced injection rate than the fracturing operation, before the hydrajetting tool 14 has moved up hole, as shown in FIG. 4B. If the isolation fluid is particularly highly viscous or contains a significant concentration of solids, preferably the hydrajetting tool 14 is moved out of the zone being plugged or partially sealed before the isolation fluid 28 is pumped downhole because the isolation fluid may impede the movement of the hydrajetting tool within the wellbore 10.

Figure 4C:
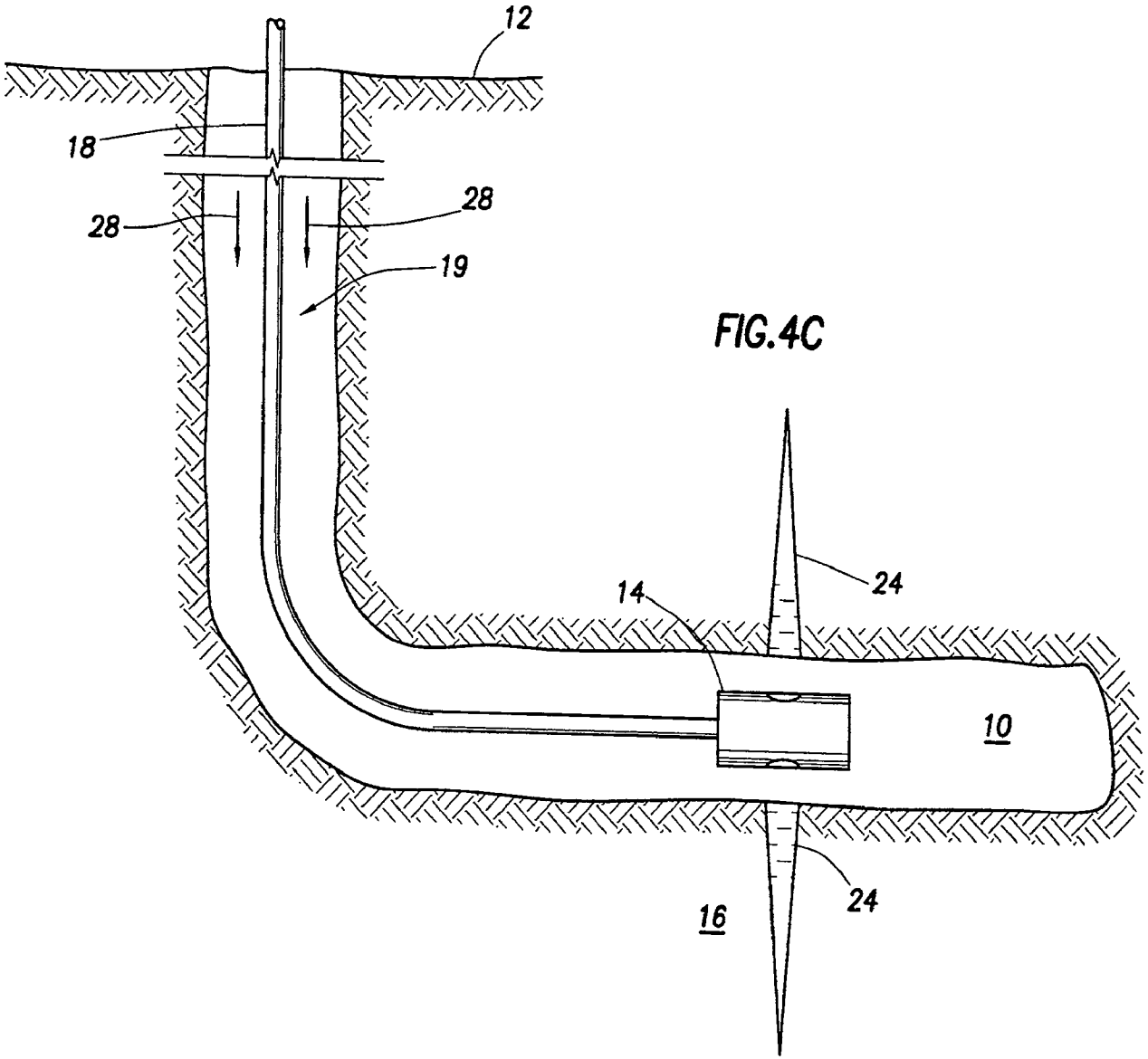
FIG. 4C is a schematic diagram illustrating another embodiment according to the present invention wherein the isolation fluid plugs the inside of the fractures rather than the wellbore alone.
Figure 4D:
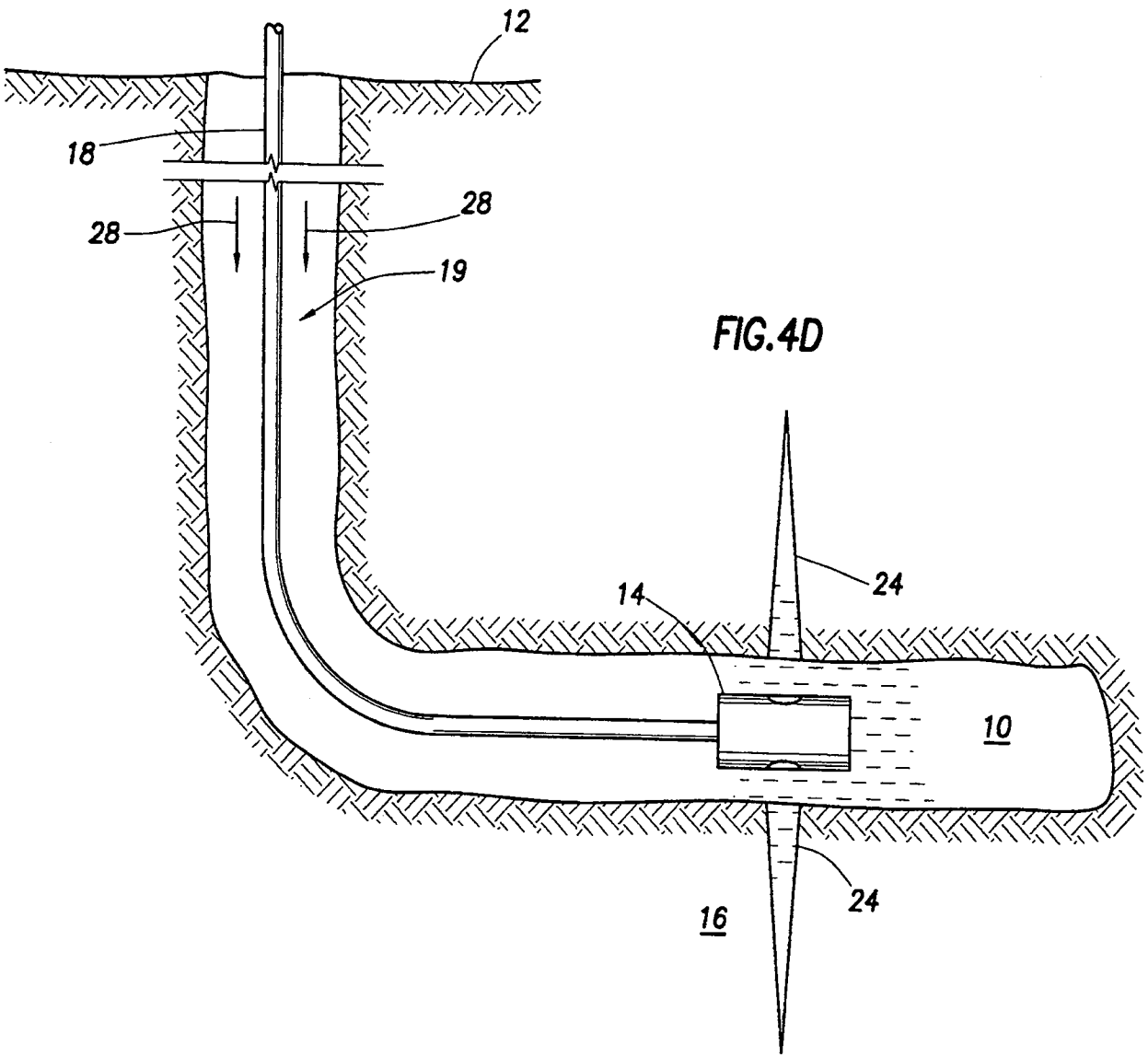
FIG. 4D is a schematic diagram illustrating another embodiment according to the present invention wherein the isolation fluid plugs the inside of the fractures and at least part of the wellbore.

In the embodiments shown in FIGS. 4A and 4B, the isolation fluid is shown in the wellbore 10 alone. Alternatively, the isolation fluid could be pumped into the jetted perforations and/or the opening of the fractures 24, as shown in FIG. 4C. In still another embodiment, the isolation fluid is pumped both in the opening of the fractures 24 and partially in the wellbore 10, as shown in FIG. 4D.

Figure 5:
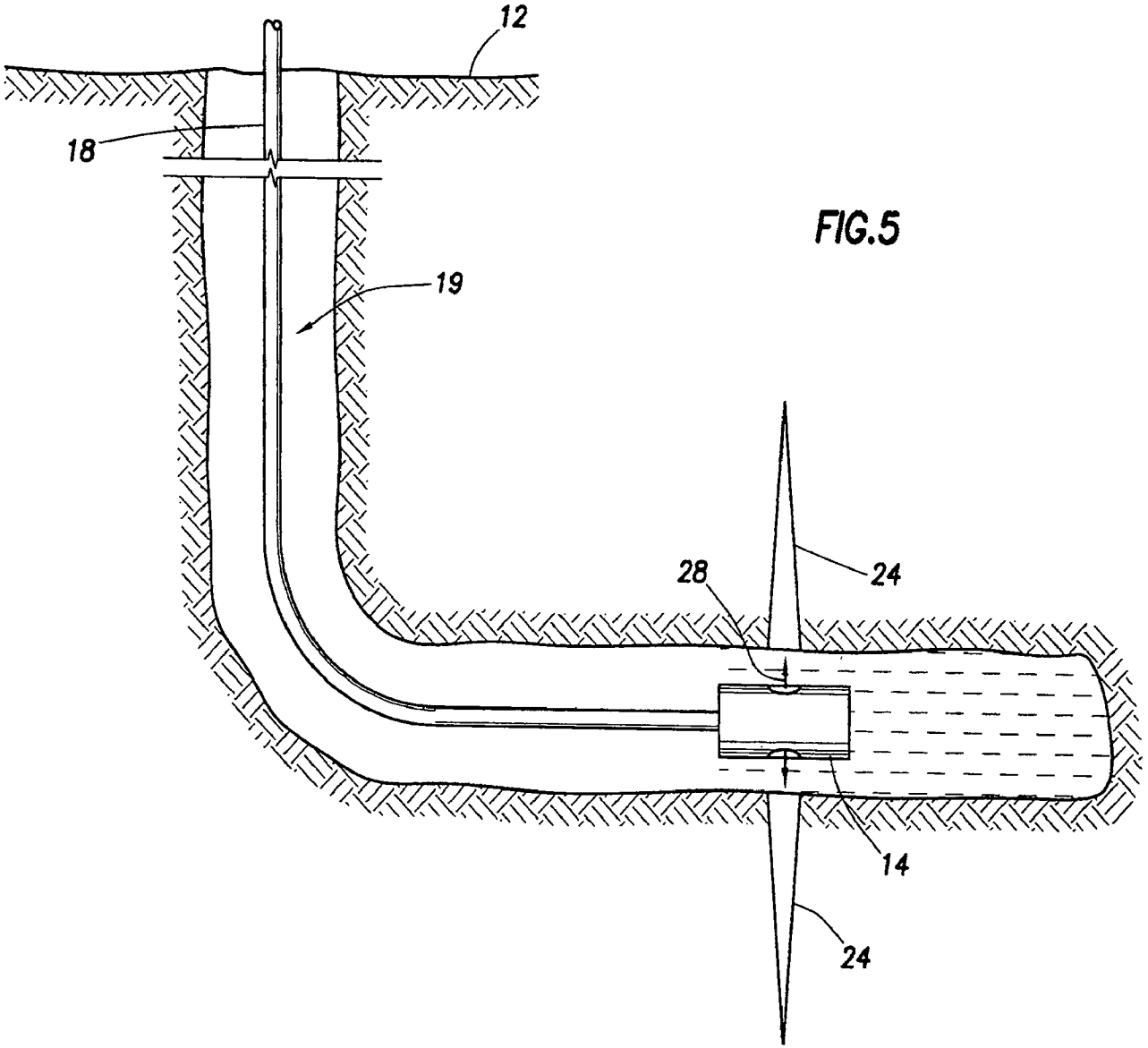
FIG. 5 is a schematic diagram illustrating another embodiment according to the present invention wherein the isolation fluid is delivered into the wellbore through the hydrajetting tool.
Figure 6:
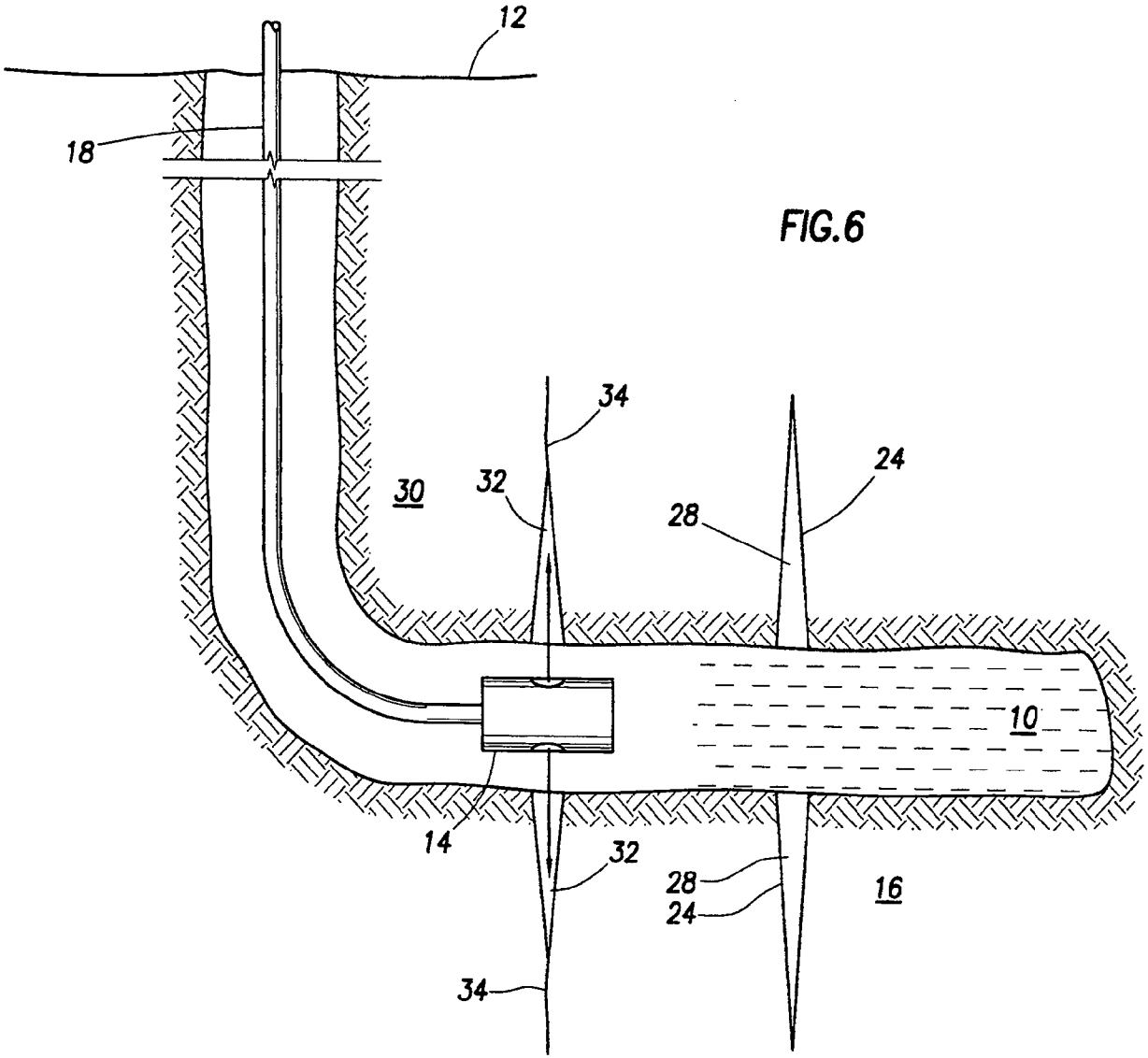
FIG. 6 is a schematic diagram illustrating the creation of fractures in a second zone of the subterranean formation by the hydrajetting tool after the first zone has been plugged.

In another exemplary embodiment of the present invention, the isolation fluid 28 is injected into the wellbore 10 adjacent the first zone 16 through the jets 22 of the hydrajetting tool 14, as shown in FIG. 5. In this embodiment, the chemistry of the isolation fluid 28 must be selected such that it does not substantially set up until after it has been injected into the wellbore 10.

In another exemplary embodiment, the isolation fluid 28 is formed of a fluid having a similar chemical makeup as the fluid resident in the wellbore during the fracturing operation. The fluid may have a greater viscosity than such fluid, however. In one exemplary embodiment, the wellbore fluid is mixed with a solid material to form the isolation fluid. The solid material may include natural and man-made proppant agents, such as silica, ceramics, and bauxites, or any such material that has an external coating of any type. Alternatively, the solid (or semi-solid) material may include paraffin, encapsulated acid or other chemical, or resin beads.

In another exemplary embodiment, the isolation fluid 28 is formed of a highly viscous material, such as a gel or cross-linked gel. Examples of gels that can be used as the isolation fluid include, but are not limited to, fluids with high concentration of gels such as Xanthan. Examples of cross-linked gels that can be used as the isolation fluid include, but are not limited to, high concentration gels (e.g., fluids that are commercially available from Halliburton Energy Services, Inc., under the trade names DELTA FRAC fluids or K-MAX fluids). "Heavy crosslinked gels" could also be used by mixing the crosslinked gels with delayed chemical breakers, encapsulated chemical breakers, which will later reduce the viscosity, or with a material such as PLA (poly-lactic acid) beads, which although being a solid material, with time decomposes into acid, which will liquefy the high concentration gels or other crosslinked gels.

After the isolation fluid 28 is delivered into the wellbore 10 adjacent the fractures 24, a second zone 30 in the subterranean formation 12 can be fractured. If the hydrajetting tool 14 has not already been moved within the wellbore 10 adjacent to the second zone 30, as in the embodiment of FIG. 4A, then it is moved there after the first zone 16 has been plugged or partially sealed by the isolation fluid 28. Once adjacent to the second zone 30, as in the embodiment of FIG. 6, the hydrajetting tool 14 operates to perforate the subterranean formation in the second zone 30 thereby forming perforation tunnels 32. Next, the subterranean formation 12 is fractured to form fractures 34 either using conventional techniques or more preferably the hydrajetting tool 14. Next, the fractures 34 are extended by continued fluid injection and using either proppant agents or acidizing fluids as noted above, or any other known technique for holding the fractures 34 open and conductive to fluid flow at a later time. The fractures 34 can then be plugged or partially sealed by the isolation fluid 28 using the same techniques discussed above with respect to the fractures 24. The method can be repeated where it is desired to fracture additional zones within the subterranean formation 12.

Figure 7:
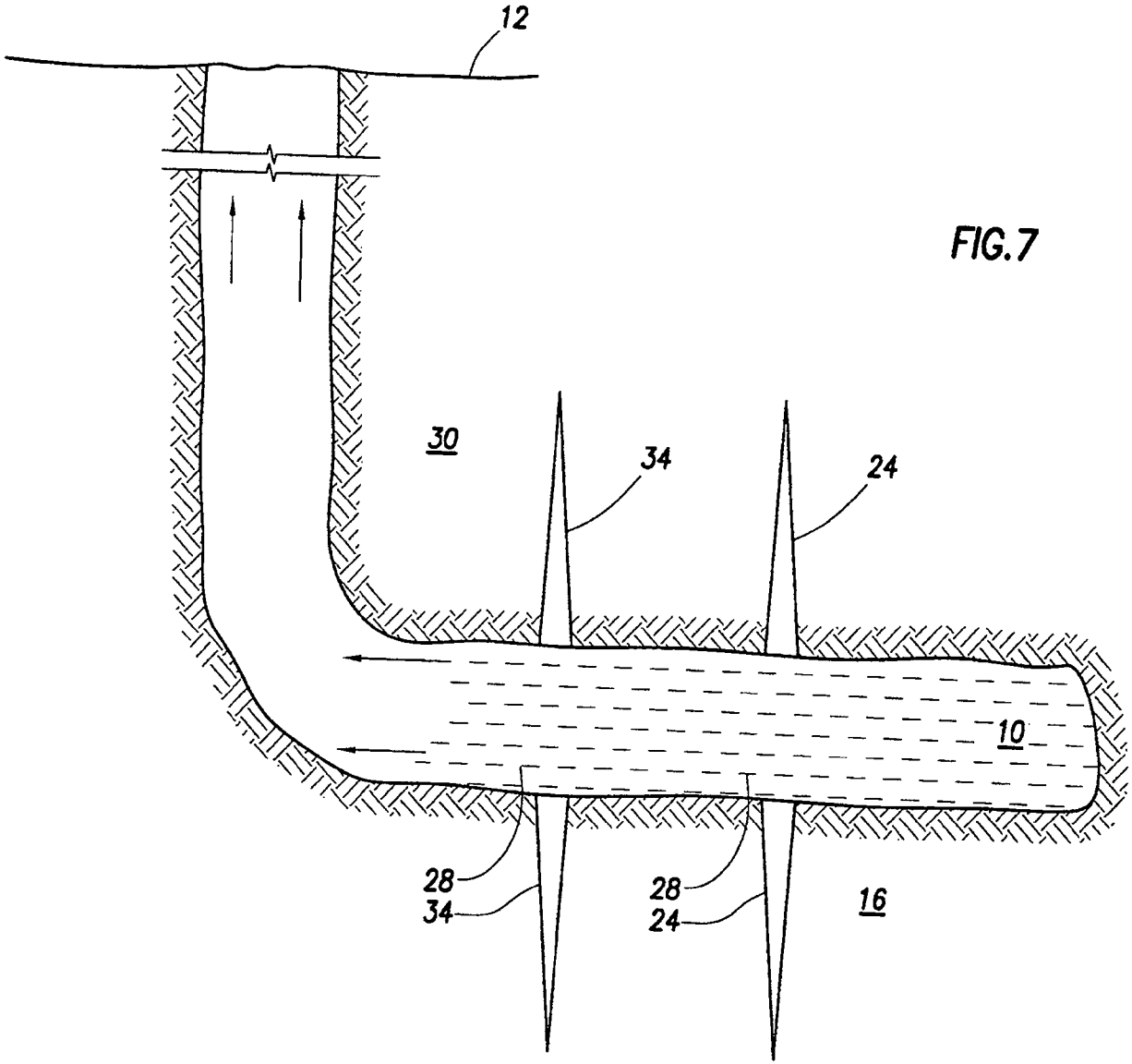
FIG. 7 is a schematic diagram illustrating one exemplary method of removing the isolation fluid from the wellbore in the subterranean formation by allowing the isolation fluid to flow out of the well with production.
Figure 8A:
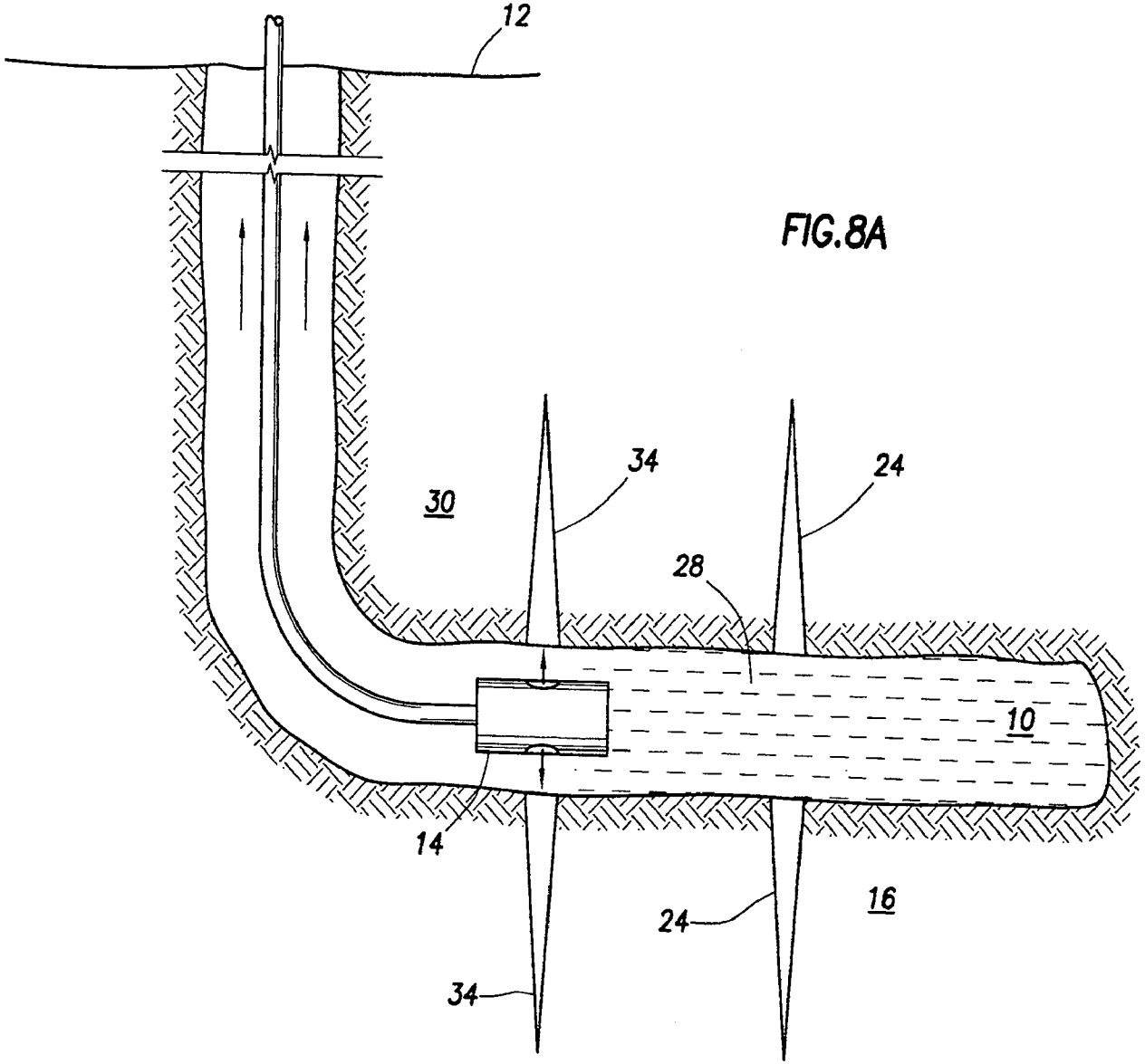
FIGS. 8A and 8B are schematic diagrams illustrating two other exemplary methods of removing the isolation fluid from the fractures in the subterranean formation.
Figure 8B:
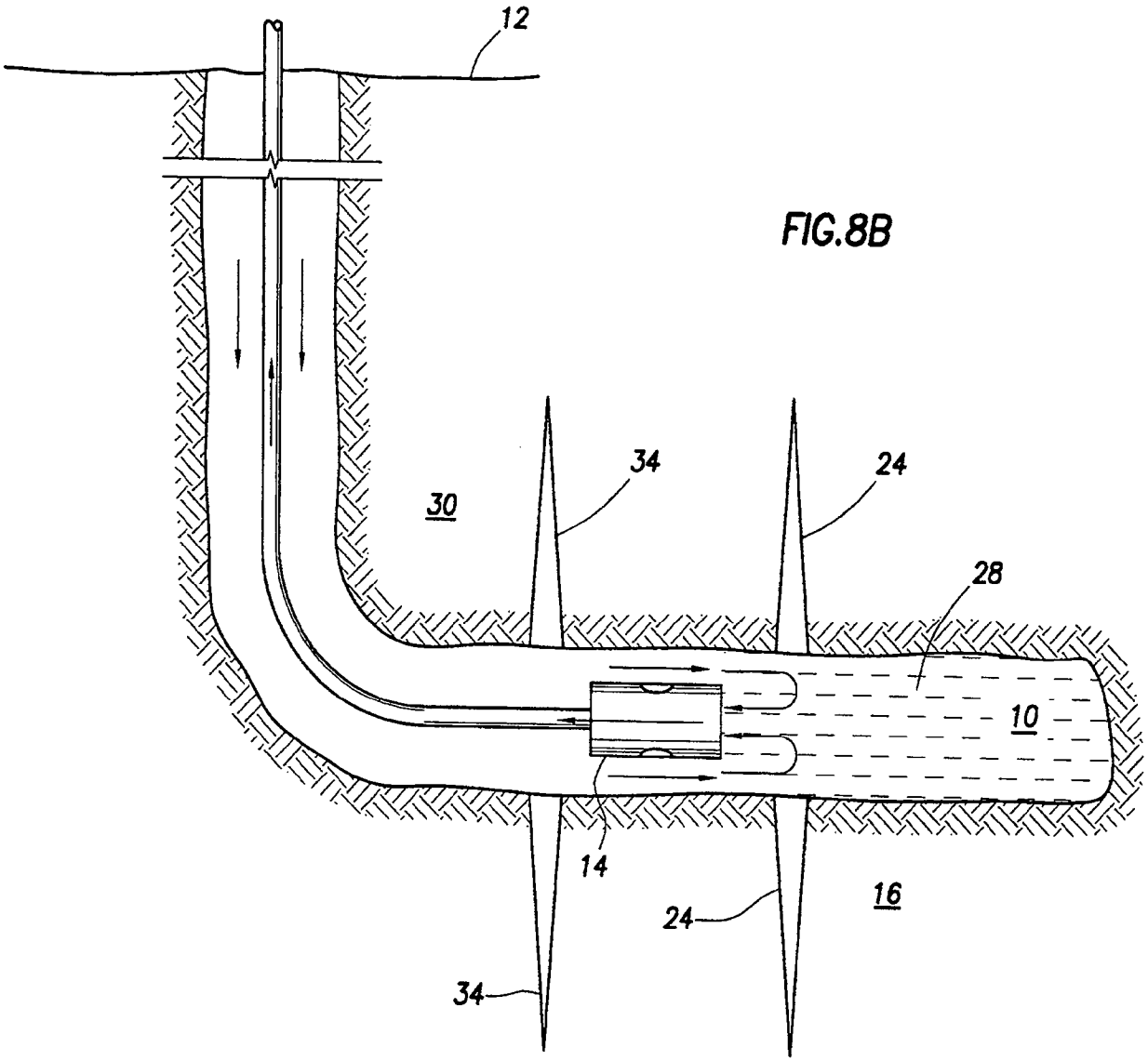

Once all of the desired zones have been fractured, the isolation fluid 28 can be recovered thereby unplugging the fractures 24 and 34 for subsequent use in the recovery of hydrocarbons from the subterranean formation 12. One method would be to allow the production of fluid from the well to move the isolation fluid, as shown in FIG. 7. The isolation fluid may consist of chemicals that break or reduce the viscosity of the fluid over time to allow easy flowing. Another method of recovering the isolation fluid 28 is to wash or reverse the fluid out by circulating a fluid, gas or foam into the wellbore 10, as shown in FIG. 8A. Another alternate method of recovering the isolation fluid 28 is to hydrajet it out using the hydrajetting tool 14, as shown in FIG. 8B. The latter methods are particularly well suited where the isolation fluid 28 contains solids and the well is highly deviated or horizontal.

The following is an another method of completing a well in a subterranean formation in accordance with the present invention. First, the wellbore 10 is drilled in the subterranean formation 12. Next, the first zone 16 in the subterranean formation 12 is perforated by injecting a pressurized fluid through the hydrajetting tool 14 into the subterranean formation (FIG. 9A), so as to form one or more perforation tunnels 20, as shown, for example, in FIG. 9B. During the performance of this step, the hydrajetting tool 14 is kept stationary. Alternatively, however, the hydrajetting tool 14 can be fully or partially rotated so as to cut slots into the formation. Alternatively, the hydrajetting tool 14 can be axially moved or a combination of rotated and axially moved within the wellbore 10 so as to form a straight or helical cut or slot. Next, one or more fractures 24 are initiated in the first zone 16 of the subterranean formation 12 by injecting a fracturing fluid into the one or more perforation tunnels through the hydrajetting tool 14, as shown, for example, in FIG. 3. Initiating the fracture with the hydrajetting tool 14 is advantageous over conventional initiating techniques because this technique allows for a lower breakdown pressure on the formation. Furthermore, it results in a more accurate and better quality perforation.

Figure 9A:
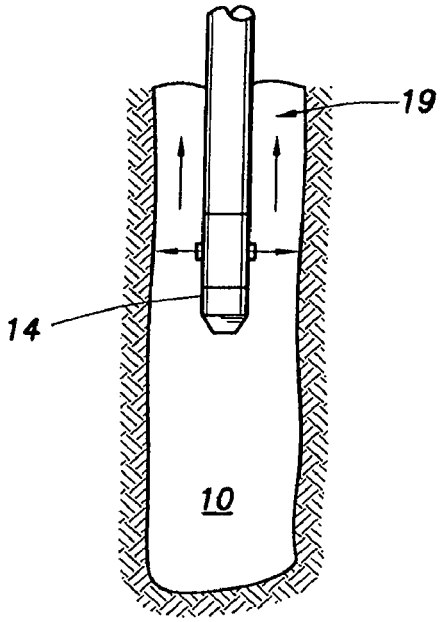
FIGS. 9A-9D illustrate another exemplary method of fracturing multiple zones in a subterranean formation and plugging or partially sealing those zones in accordance with the present invention.
Figure 9C:
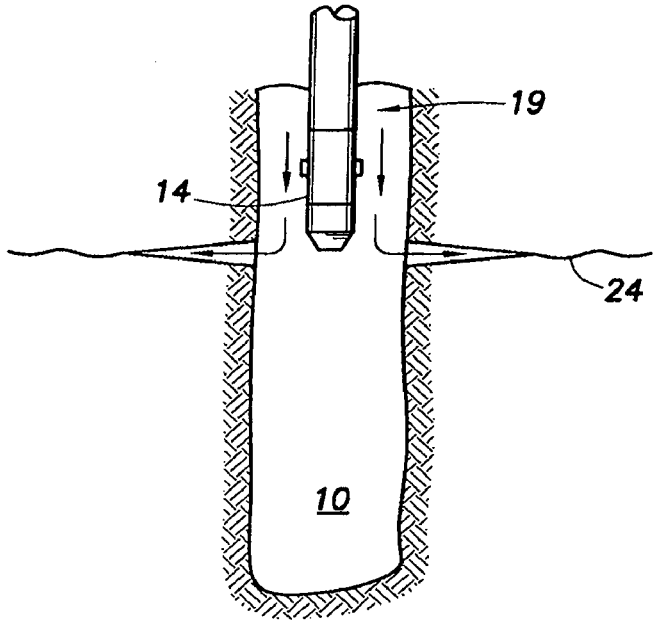
Figure 9B:
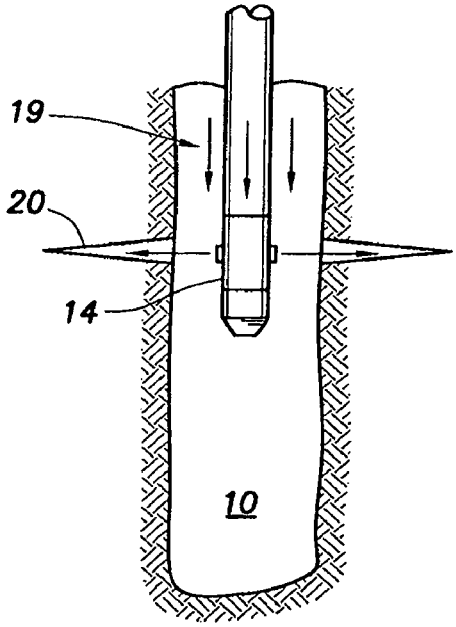
Figure 9D:
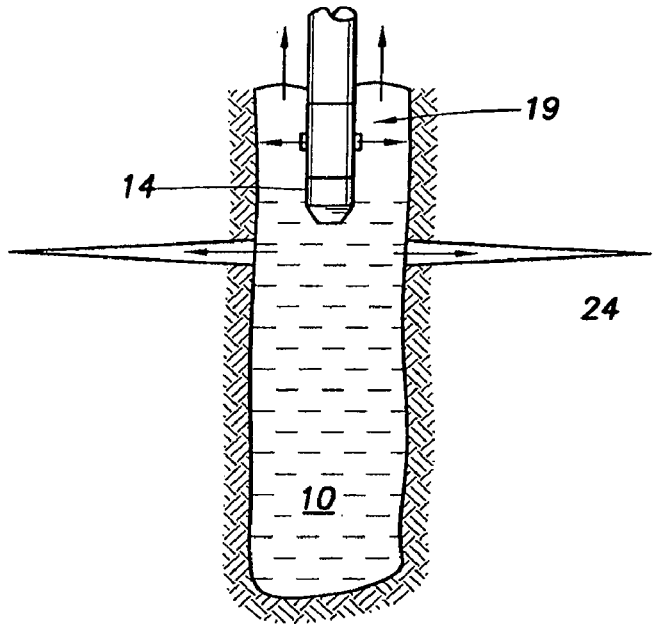

Fracturing fluid can be pumped down the annulus 19 as soon as the one or more fractures 24 are initiated, so as to propagate the fractures 24, as shown in FIG. 9B, for example. Any cuttings left in the annulus from the perforating step are pumped into the fractures 24 during this step. After the fractures 24 have been initiated, the hydrajetting tool 14 is moved up hole. This step can be performed while the fracturing fluid is being pumped down through the annulus 19 to propagate the fractures 24, as shown in FIG. 9C. The rate of fluid being discharged through the hydrajetting tool 14 can be decreased once the fractures 24 have been initiated. The annulus injection rate may or may not be increased at this juncture in the process.

After the fractures 24 have been propagated and the hydrajetting tool 14 has been moved up hole, the isolation fluid 28 in accordance with the present invention can be pumped into the wellbore 10 adjacent to the first zone 16. Over time the isolation fluid 28 plugs the one or more fractures 24 in the first zone 16, as shown, for example, in FIG. 9D. (Although not shown, those of skill in the art will appreciate that the isolation fluid 28 can permeate into the fractures 24.) The steps of perforating the formation, initiating the fractures, propagating the fractures and plugging or partially sealing the fractures are repeated for as many additional zones as desired, although only a second zone 30 is shown in FIGS. 6-10.

After all of the desired fractures have been formed, the isolation fluid 28 can be removed from the subterranean formation 12. There are a number of ways of accomplishing this in addition to flowing the reservoir fluid into the wellbore and to those already mentioned, namely reverse circulation and hydrajetting the fluid out of the wellbore 10. In another method, acid is pumped into the wellbore 10 so as to activate, de-activate, or dissolve the isolation fluid 28 in situ. In yet another method, nitrogen is pumped into the wellbore 10 to flush out the wellbore and thereby remove it of the isolation fluid 28 and other fluids and materials that may be left in the wellbore.

Yet another method in accordance with the present invention will now be described. First, as with the other methods, wellbore 10 is drilled. Next, first zone 16 in subterranean formation 12 is perforated by injecting a pressurized fluid through hydrajetting tool 14 into the subterranean formation, so as to form one or more perforation tunnels 20. The hydrajetting tool 14 can also be rotated or rotated and/or axially moved during this step to cut slots into the subterranean formation 12. Next, one or more fractures 24 are initiated in the first zone 16 of the subterranean formation by injecting a fracturing fluid into the one or more perforation tunnels 20 through the hydrajetting tool 14. Following this step or simultaneous with it, additional fracturing fluid is pumped into the one or more fractures 24 in the first zone 16 through annulus 19 in the wellbore 10 so as to propagate the fractures 24. Any cuttings left in the annulus after the drilling and perforation steps may be pumped into the fracture during this step. Simultaneous with this latter step, the hydrajetting tool 14 is moved up hole. Pumping of the fracture fluid into the formation through annulus 19 is then ceased. All of these steps are then repeated for the second zone 30 and any subsequent zones thereafter. The rate of the fracturing fluid being ejected from the hydrajetting tool 14 is decreased as the tool is moved up hole and even may be halted altogether.

An additional method in accordance with the present invention will now be described. First, as with the other methods, wellbore 10 is drilled. Next, first zone 16 in subterranean formation 12 is perforated by injecting a pressurized fluid through hydrajetting tool 14 into the subterranean formation, so as to form one or more perforation tunnels 20. The hydrajetting tool 14 can be rotated during this step to cut slots into the subterranean formation 12. Alternatively, the hydrajetting tool 14 can be rotated and/or moved axially within the wellbore 10, so as to create a straight or helical cut into the formation 16. Next, one or more fractures 24 are initiated in the first zone 16 of the subterranean formation by injecting a fracturing into the one or more perforation tunnels or cuts 20 through the hydrajetting tool 14. Following this step or simultaneous with it, additional fracturing fluid is pumped into the one or more fractures 24 in the first zone 16 through annulus 19 in the wellbore 10 so as to propagate the fractures 24. Any cuttings left in the annulus after the drilling and perforation steps are pumped into the fracture during this step. Simultaneous with this latter step, the hydrajetting tool 14 is moved up hole and operated to perforate the next zone. The fracturing fluid is then ceased to be pumped down the annulus 19 into the fractures, at which time the hydrajetting tool starts to initiate the fractures in the second zone. The process then repeats.

Figure 10A:
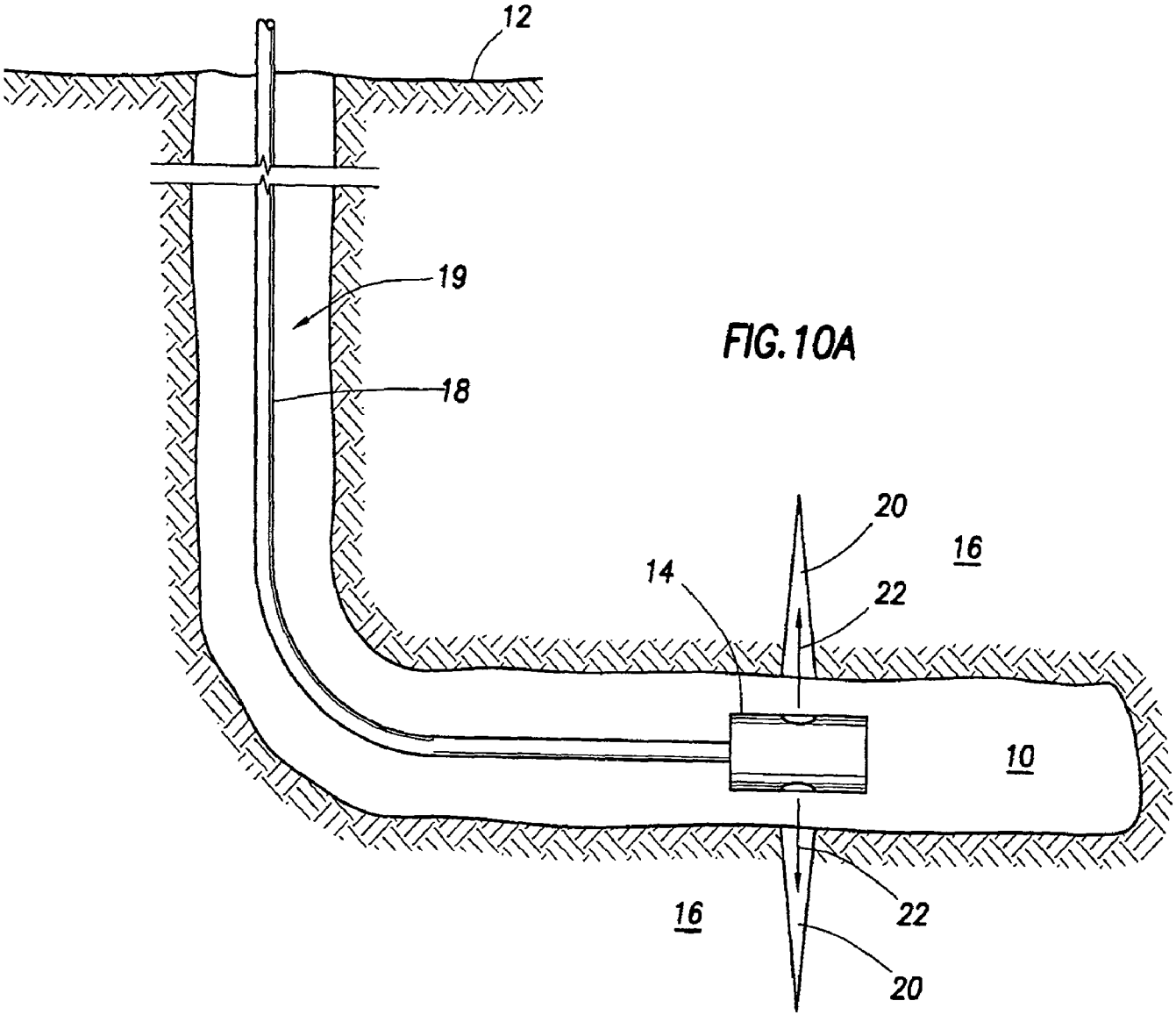
FIGS. 10A-C illustrate yet another exemplary method of fracturing multiple zones in a subterranean formation and plugging or partially sealing those zones in accordance with the present invention.

Yet another method in accordance with the present invention will now be described with reference to FIGS. 10A-C. First, as with the other methods, wellbore 10 is drilled. Next, first zone 16 in subterranean formation 12 is perforated by injecting a pressurized fluid through hydrajetting tool 14 into the subterranean formation, so as to form one or more perforation tunnels 20, as shown in FIG. 10A. The fluid injected into the formation during this step typically contains an abrasive to improve penetration. The hydrajetting tool 14 can be rotated during this step to cut a slot or slots into the subterranean formation 12. Alternatively, the hydrajetting tool 14 can be rotated and/or moved axially within the wellbore 10, so as to create a straight or helical cut into the formation 16.

Figure 10B:
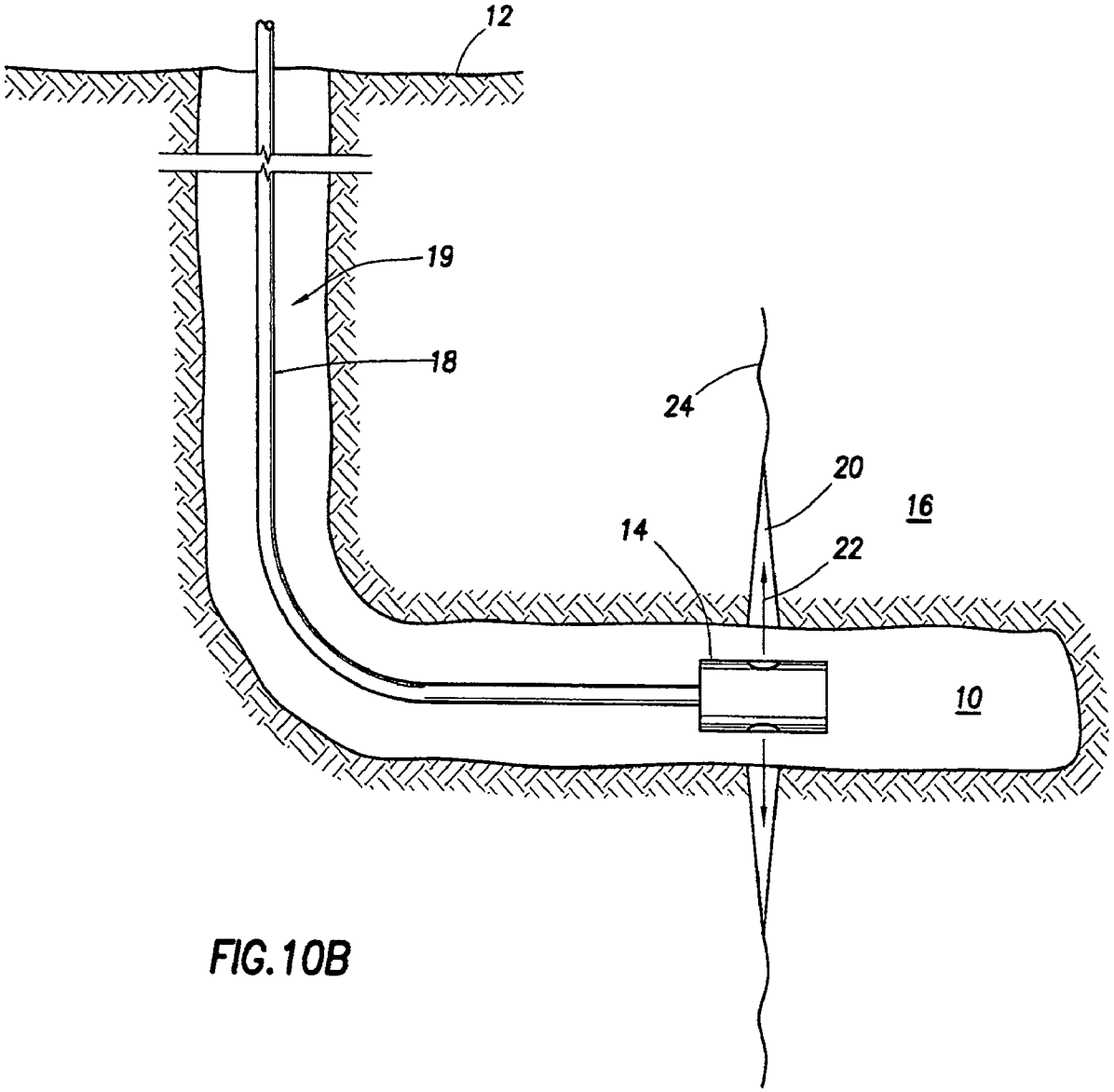
Figure 10C:
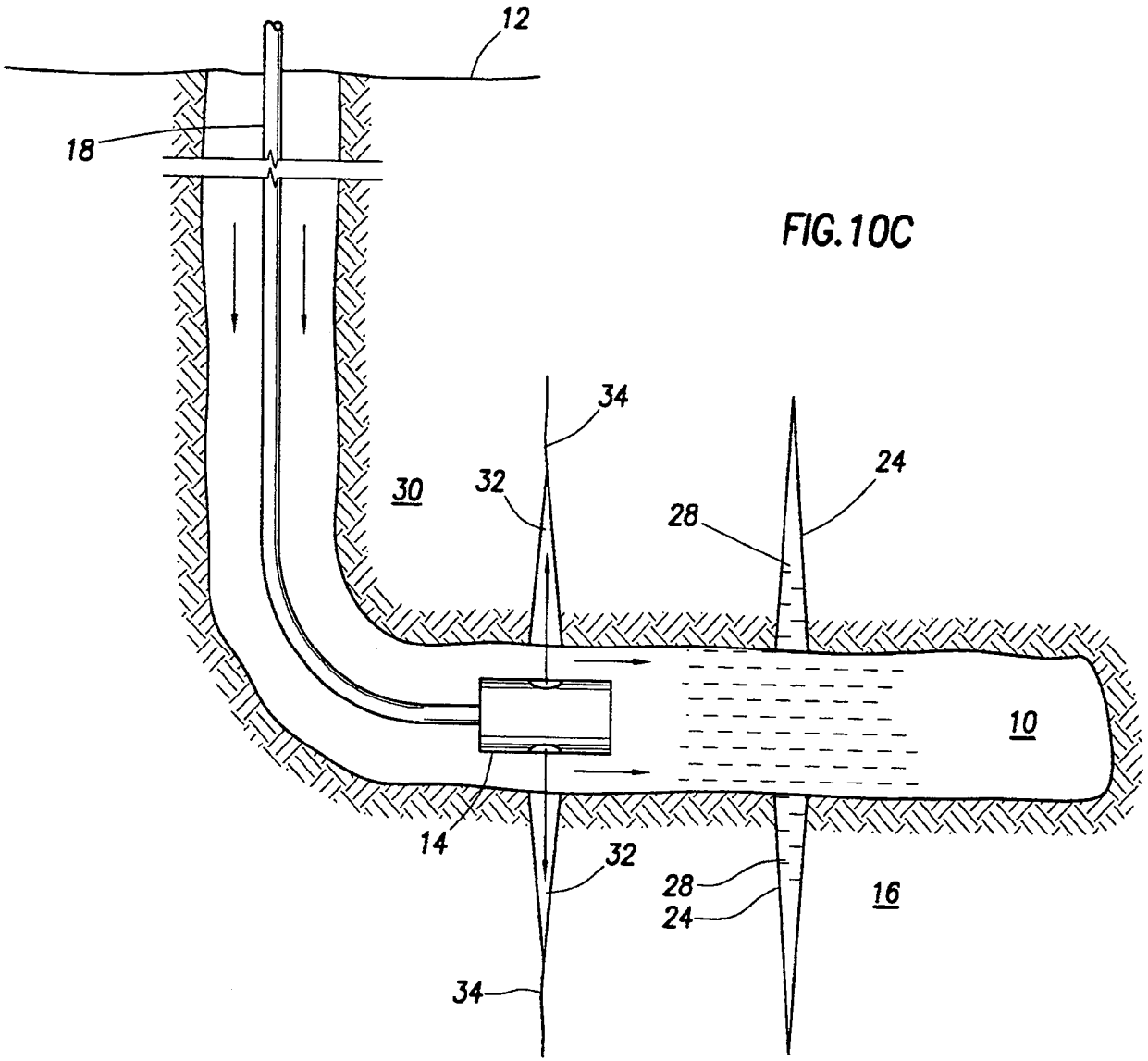

Next, one or more fractures 24 are initiated in the first zone 16 of the subterranean formation by injecting a fracturing fluid into the one or more perforation tunnels or cuts 20 through the hydrajetting tool 14 , as shown in FIG. 10B. During this step the base fluid injected into the subterranean formation may contain a very small size particle, such as a 100 mesh silica sand, which is also known as Oklahoma No. 1. Next, a second fracturing fluid that may or may not have a second viscosity greater than that of the first fracturing fluid, is injected into the fractures 24 to thereby propagate said fractures. The second fracturing fluid comprises the base fluid, sand, possibly a crosslinker, and one or both of an adhesive and consolidation agent. In one embodiment, the adhesive is a conductivity enhancer, e.g., SANDWEDGE® conductivity enhancer, manufactured by Halliburton and the consolidation agent is EXPEDITE consolidation agent also manufactured by Halliburton. The second fracturing fluid may be delivered in one or more of the ways described herein. Also, an acidizing step may also be performed.

Next, the hydrajetting tool 14 is moved to the second zone 30, where it perforates that zone thereby forming perforation tunnels or cuts 32. Next, the fractures 34 in the second zone 30 are initiated using the above described technique or a similar technique. Next, the fractures 34 in the second zone are propagated by injecting a second fluid similar to above, i.e., the fluid containing the adhesive and/or consolidation agent into the fractures. Enough of the fracturing fluid is pumped downhole to fill the wellbore and the openings of fractures 24 in the first zone 16. This occurs as follows. The high temperature downhole causes the sand particles in the fracture fluid to bond to one another in clusters or as a loosely packed bed and thereby form an in situ plug. Initially, some of the fluid, which flows into the jetted tunnels and possibly part way into fractures 24 being concentrated as part of the liquid phase, leaks out into the formation in the first zone 16, but as those of ordinary skill in the art will appreciate, it is not long before the openings become plugged or partially sealed. Once the openings of the fractures 24 become filled, enough fracture fluid can be pumped down the wellbore 10 to fill some or all of the wellbore 10 adjacent fractures 24, as shown in FIG. 10C. Ultimately, enough fracture fluid and proppant can be pumped downhole to cause the first zone 16 to be plugged or partially sealed. This process is then repeated for subsequent zones after subsequent perforating and fracturing stages uphole.

Figure 11A:
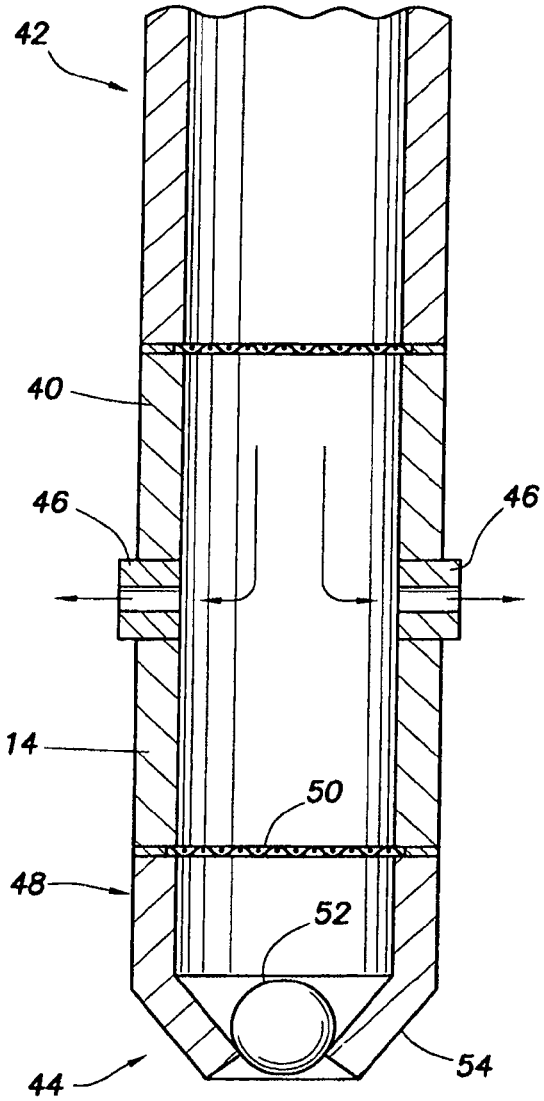
FIGS. 11A and 11B illustrate operation of a hydrajetting tool for use in carrying out the methods according to the present invention.
Figure 11B:
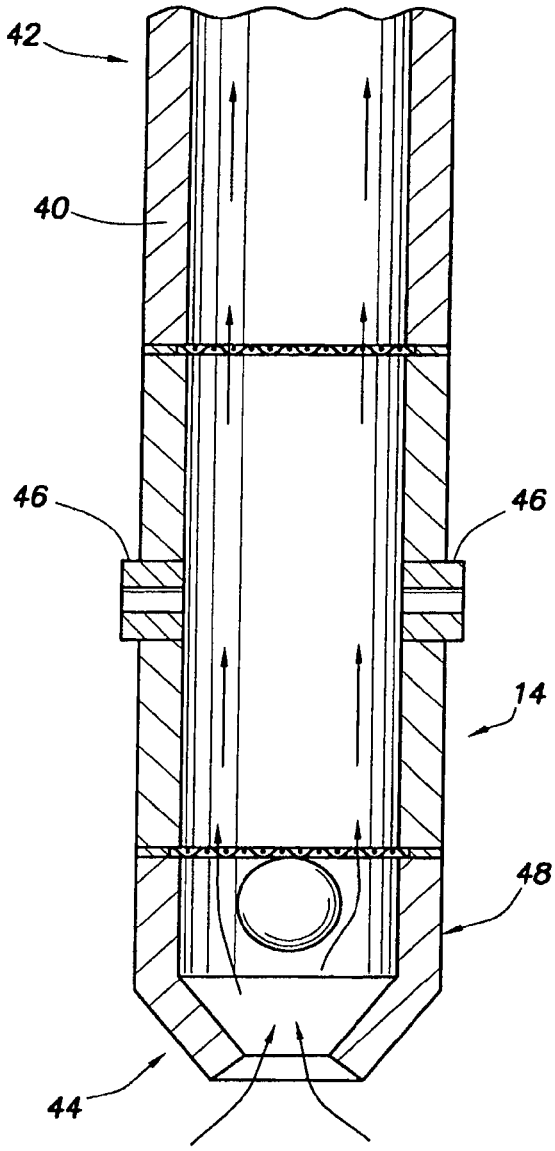

FIGS. 11A-B illustrate the details of the hydrajetting tool 14 for use in carrying out the methods of the present invention. Hydrajetting tool 14 comprises a main body 40, which is cylindrical in shape and formed of a ferrous metal. The main body 40 has a top end 42 and a bottom end 44. The top end 42 connects to coil tubing 18 for operation within the wellbore 10. The main body 40 has a plurality of nozzles 46, which are adapted to direct the high pressure fluid out of the main body 40. The nozzles 46 can be disposed, and in one certain embodiment are disposed, at an angle to the main body 40, so as to eject the pressurized fluid out of the main body 40 at an angle other than 90°.

The hydrajetting tool 14 further comprises means 48 for opening the hydrajetting tool 14 to fluid flow from the wellbore 10. Such fluid opening means 48 includes a fluid-permeable plate 50, which is mounted to the inside surface of the main body 40. The fluid-permeable plate 50 traps a ball 52, which sits in seat 54 when the pressurized fluid is being ejected from the nozzles 46, as shown in FIG. 11A. When the pressurized fluid is not being pumped down the coil tubing into the hydrajetting tool 14, the wellbore fluid is able to be circulated up to the surface via opening means 48. More specifically, the wellbore fluid lifts the ball 52 up against fluid-permeable plate 50, which in turn allows the wellbore fluid to flow up the hydrajetting tool 14 and ultimately up through the coil tubing 18 to the surface, as shown in FIG. 11B. As those of ordinary skill in the art will recognize other valves can be used in place of the ball and seat arrangement 52 and 54 shown in FIGS. 11A and 11B. Darts, poppets, and even flappers, such as a balcomp valves, can be used. Furthermore, although FIGS. 11A and 11B only show a valve at the bottom of the hydrajetting tool 14, such valves can be placed both at the top and the bottom, as desired.

In yet another method in accordance with the present invention will now be described. First, the first zone 16 in the subterranean formation 12 is perforated by injecting a perforating fluid through the hydrajetting tool 14 into the subterranean formation, so as to form perforation tunnels 20, as shown, for example, in FIG. 1A. Next, fractures 24 are initiated in the perforation tunnels 20 by pumping a fracturing fluid through the hydrajetting tool 14, as shown, for example in FIG. 3. The fractures 24 are then propagated by injecting additional fracturing fluid into the fractures through both the hydrajetting tool 14 and annulus 19. The fractures 24 are then plugged, at least partially, by pumping an isolation fluid 28 into the openings of the fractures 24 and/or wellbore section adjacent to the fractures 24. The isolation fluid 28 can be pumped into this region either through the annulus 19, as shown in FIG. 4, or through the hydrajetting tool 14, as shown in FIG. 5, or a combination of both. Once the fractures 24 have been plugged, the hydrajetting tool 14 is moved away from the first zone 16. It can either be moved up hole for subsequent fracturing or downhole, e.g., when spotting a fluid across perforations for sealing where it is desired to pump the chemical from a point below the zone of interest to get full coverage—the tool is then pulled up through the spotted chemical. Lastly, these steps or a subset thereof, are repeated for subsequent zones of the subterranean formation 12.

As is well known in the art, a positioning device, such as a gamma ray detector or casing collar locator (not shown), can be included in the bottom hole assembly to improve the positioning accuracy of the perforations.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. In particular, as those of skill in the art will appreciate, steps from the different methods disclosed herein can be combined in a different manner and order. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of completing a well in a subterranean formation, comprising the steps of:

(a) perforating a first zone in the subterranean formation by injecting a pressurized fluid through a hydrajetting tool into the subterranean formation, so as to form one or more perforation tunnels;

(b) injecting a fracturing fluid into the one or more perforation tunnels so as to create at least one fracture along each of the one or more perforation tunnels;

(c) moving the hydrajetting tool to a second zone in the subterranean formation;

(d) perforating the second zone by injecting the pressurized fluid through the hydrajetting tool into the subterranean formation, so as to form one or more additional perforation tunnels;

(e) injecting the fracturing fluid into the one or more additional perforation tunnels so as to create at least one fracture along each of the one or more additional perforation tunnels; and (f) plugging at least partially the one or more fractures in the first zone with an enhancing isolation fluid;

wherein step (c) is performed before steps (d) and (e); and wherein step (d) is performed before step (f).

2. The method of completing a well according to claim 1, wherein the pressurized fluid being injected into the subterranean formation through the hydrajetting tool during steps (a) and (d) comprises abrasive solids.

3. The method of completing a well according to claim 1, wherein the steps of injecting the fracturing fluid into the first and second zones is performed by the hydrajetting tool, which injects the fluid into the zones at a pressure above that required to fracture the formation.

4. The method of completing a well according to claim 3, further comprising a step of injecting an acidizing fluid into each of the fractures, so as to etch the one or more fractures and thereby maintain conductivity within the fractures at a later time.

5. The method of completing a well according to claim 1, wherein the isolation fluid comprises a solid or semi-solid material.

6. The method of completing a well according to claim 5, wherein the solid material comprises a proppant agent.

7. The method of completing a well according to claim 6, wherein the proppant agent comprises a material selected from the group consisting of silica, a ceramic, and a bauxite.

8. The method of completing a well according to claim 5, wherein the solid material comprises a material selected from the group consisting of paraffin beads, resin solids and PLA.

9. The method of completing a well according to claim 5, wherein the solid material comprises a material selected from the group consisting of paraffin beads, resin solids and PLA.

10. The method of completing a well according to claim 9, wherein the gel is a cross-linked gel.

11. The method of completing a well according to claim 10, wherein the cross-linked gel comprises PLA beads.

12. The method of completing a well according to claim 1, further comprising the step of removing the isolation fluid from the first zone.

13. The method of completing a well according to claim 12, wherein the step of removing the isolation fluid from the first zone is performed by circulating the isolation fluid out of the wellbore.

14. The method of completing a well according to claim 12, wherein the step of removing the isolation fluid from the first zone is performed by hydrajetting the isolation fluid out of the wellbore.

15. The method of completing a well according to claim 1, wherein each of the fractures has an opening adjacent to the wellbore.

16. The method of completing a well according to claim 15, wherein the opening of each of the fractures is filled with the isolation fluid.

17. The method of completing a well according to claim 15, wherein the isolation fluid fills at least a portion of the wellbore adjacent to each opening.

18. The method of completing a well according to claim 17, wherein the isolation fluid also fills each opening.

19. The method of completing a well according to claim 1, wherein the hydrajetting tool is kept stationary during step (a).

20. The method of completing a well according to claim 1, wherein the hydrajetting tool rotates during step (a) thereby cutting at least one slot into the first zone of the subterranean formation.

21. The method of completing a well according to claim 1, wherein the hydrajetting tool rotates and/or moves axially within the wellbore during step (a) so as to thereby cut a straight or helical slot into the first zone of the subterranean formation.

22. The method of completing a well according to claim 1, wherein steps (b) and (d) are performed substantially simultaneously.

23. A method of completing a well in a subterranean formation, comprising the steps of:

(a) perforating a first zone in the subterranean formation by injecting a pressurized fluid through a hydrajetting tool into the subterranean formation, so as to form one or more perforation tunnels;

(b) initiating one or more fractures in the first zone of the subterranean formation by injecting a fracturing fluid into the one or more perforation tunnels through the hydrajetting tool;

(c) moving the hydrajetting tool up hole to a second zone in the subterranean formation;

(d) perforating the second zone by injecting the pressurized fluid through the hydrajetting tool into the subterranean formation, so as to form one or more additional perforation tunnels;

(e) initiating one or more fractures in the second zone of the subterranean formation by injecting the fracturing fluid into the one or more additional perforation tunnels through the hydrajetting tool;

(f) pumping additional fracturing fluid into the one or more fractures in the first zone through a wellbore annulus in which the hydrajetting tool is disposed so as to propagate the fracture; and (g) plugging at least partially the one or more fractures in the first zone with an isolation fluid;

wherein step (c) is performed before steps (d) and (e); and wherein step (d) is performed before step (g).

24. The method of completing a well according to claim 23, wherein additional fracturing fluid is pumped through the annulus to assist the hydrajetting tool initiate the one or more fractures in the first zone of the subterranean formation.

25. The method of completing a well according to claim 23, wherein the one or more fractures in the first zone are formed in a horizontal or deviated portion of the wellbore.

26. The method of completing a well according to claim 23, wherein the one or more fractures in the first zone are formed in a vertical portion of the wellbore.

27. The method of completing a well according to claim 23, wherein the hydrajetting tool is kept stationary during steps (a) and (d).

28. The method of completing a well according to claim 23, wherein the hydrajetting tool rotates during step (a) thereby cutting at least one slot into the first zone of the subterranean formation.

29. The method of completing a well according to claim 28, wherein the hydrajetting tool rotates and/or moves axially within the wellbore during step (a) so as to thereby cut a straight or helical slot into the first zone of the subterranean formation.

30. The method of completing a well according to claim 23, wherein the fracturing fluid is pumped down the annulus as soon as the one or more fractures are initiated in the first zone.

31. The method of completing a well according to claim 23, wherein any cuttings left in the annulus from step (a) are pumped into the fracture during step (f).

32. The method of completing a well according to claim 23, wherein steps (c) and (g) are performed simultaneously.

33. The method of completing a well according to claim 32, wherein the rate of fluid ejected from the hydrajetting tool decreases during the performance of step (c).

34. The method of completing a well according to claim 23, further comprising the step of pumping acid into the wellbore to activate or dissolve the isolation fluid after all of the desired fractures have been formed.

35. The method of completing a well according to claim 23, further comprising the step of circulating the isolation fluid back to the surface after all of the desired fractures have been formed.

36. The method of completing a well according to claim 23, further comprising the step of pumping nitrogen into the wellbore to flush out the wellbore and remove it of the isolation fluid and other fluids and materials that may be left in the wellbore.

37. A method of completing a well in a subterranean formation, comprising the steps of:

(a) perforating a first zone in the subterranean formation by injecting a perforating fluid through a hydrajetting tool into the subterranean formation, so as to form one or more perforation tunnels;

(b) fracturing the first zone of the subterranean formation by injecting a fracturing fluid into the one or more perforation tunnels;

(c) perforating a second zone in the subterranean formation by injecting the perforation fluid through the hydrajetting tool into the subterranean formation, so as to form one or more perforation tunnels in the second zone;

(d) fracturing the second zone of the subterranean formation by injecting the fracturing fluid into the one or more perforation tunnels; and (e) pumping enough fracturing fluid into the welibore during step (d) to plug the fractures in the first zone;

wherein step (a) is performed before steps (b) and (c), and steps (b) and (c) are performed before step (e).

38. The method of completing a well according to claim 37, wherein steps (b) and (c) are performed substantially simultaneously.

39. A method of completing a well in a subterranean formation, comprising the steps of:

(a) perforating a first zone in the subterranean formation by injecting a perforating fluid through a hydrajetting tool into the subterranean formation, so as to form one or more perforation tunnels;

(b) fracturing the first zone of the subterranean formation by injecting a fracturing fluid into the one or more perforation tunnels;

(c) perforating a second zone in the subterranean formation by injecting the perforation fluid through the hydrajetting tool into the subterranean formation, so as to form one or more perforation tunnels in the second zone;

(d) fracturing the second zone of the subterranean formation by injecting the fracturing fluid into the one or more perforation tunnels; and (e) pumping enough fracturing fluid into the wellbore during step (d) to plug the fractures in the first zone;

wherein the fracturing fluid comprises a base fluid, sand, and an additional additive selected from the group consisting of an adhesive and a consolidation agent; and wherein step (a) is performed before steps (b) and (c), and steps (b) and (c) are performed before step (e).

40. The method of completing a well according to claim 39, wherein the fracturing fluid comprises both the adhesive and the consolidation agent.

41. The method of completing a well according to claim 40, wherein the adhesive is a conductivity enhancer.

42. The method of completing a well according to claim 39, wherein steps (b) and (c) are performed substantially simultaneously.

* * * * *